US007488050B2

(12) United States Patent
Takagi

(10) Patent No.: US 7,488,050 B2
(45) Date of Patent: Feb. 10, 2009

(54) IMAGE FORMING APPARATUS

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 401 days.

(21) Appl. No.: 11/364,271

(22) Filed: Mar. 1, 2006

(65) Prior Publication Data

US 2006/0209120 A1 Sep. 21, 2006

(30) Foreign Application Priority Data

Mar. 1, 2005 (JP) ..... 2005-055875
Mar. 4, 2005 (JP) ..... 2005-061676
Mar. 4, 2005 (JP) ..... 2005-061678

(51) Int. Cl.
*B41J 2/165* (2006.01)

(52) U.S. Cl. ..... 347/29; 347/223; 347/32; 347/35

(58) Field of Classification Search ..... 347/22–35
See application file for complete search history.

(56) References Cited

U.S. PATENT DOCUMENTS 5,483,267 A 1/1996 Nemura et al.
2005/0275706 A1 12/2005 Takagi et al.

FOREIGN PATENT DOCUMENTS

EP 1405725 A1 4/2004
JP 2955384 7/1999
JP 2005 349793 12/2005

OTHER PUBLICATIONS

European Patent Office, European Search Report for Related EP Application No. 06251078 dated Aug. 1, 2006.

*Primary Examiner*—Shih-Wen Hsieh
(74) *Attorney, Agent, or Firm*—Baker Botts L.L.P.

(57) ABSTRACT

An image forming apparatus includes a conveyance unit, nozzles, a recording unit, a cap unit, a first moving mechanism, a first ink receiving unit and a second moving mechanism. The first moving mechanism reciprocates the cap unit between a capping position and a non-capping position apart. The first ink receiving unit includes an ink receiving region larger than a region that all the nozzles occupy. The second moving mechanism reciprocates the first ink receiving unit between an ink receiving position and an ink non-receiving position. When the first ink receiving unit is located at the ink non-receiving position, at least a part of the first ink receiving unit overlaps the cap unit located at the non-capping position. When the cap unit is located at the capping position, the first ink receiving unit is located at the ink receiving position and overlaps the entire cap unit.

31 Claims, 17 Drawing Sheets

IMAGE FORMING APPARATUS

CROSS-REFERENCE TO RELATED APPLICATIONS

This application is based upon and claims the benefit of priority from Japanese Patent Application No. 2005-55875 filed on Mar. 1, 2005, Japanese Patent Application No. 2005-61676 filed on Mar. 4, 2005 and Japanese Patent Application No. 2005-61678 filed on Mar. 4, 2005; the entire contents of which are incorporated herein by reference.

BACKGROUND OF THE INVENTION

1. Field of the Invention

The invention relates to an image forming apparatus, which can execute a purge operation at high speed so as to restore ink ejection performance, and can downsize an entire apparatus including an ink receiving unit for receiving ink in the purge operation.

2. Description of the Related Art

Image forming apparatuses have been known in which recording heads corresponding to respective colors are arranged in parallel and ink is ejected onto a recording medium, which is being conveyed, from nozzles formed in the recording heads, to thereby form an image on the recording medium.

In such image forming apparatuses, ink lump or air is sometimes clogged in the nozzles, and then normal ink ejection performance is obstructed. Therefore, a purge operation is executed so as to restore ink ejection performance. For example, the purge operation is executed so that the ink lump or air clogged in the nozzles is removed from the nozzles to the outside by ejecting ink from the nozzles at an unusual great pressure. At this time, since ink is discharged together with the ink lump or air, the image forming apparatuses have an ink receiving unit that receives discharged ink.

Also, in this type of image forming apparatuses, in order to prevent ink in the nozzles from being dried when the apparatus is not used, a cap unit, which can abut against a nozzle formation surface of each recording head so as to form a closed space in which the nozzle formation surface is sealed up is provided.

U.S. Pat. No. 5,483,267 discloses such an image forming apparatus having the ink receiving unit and the cap unit.

The ink jet recording apparatus has four recording heads corresponding to four colors of cyan, magenta, yellow, and black. Further, an ink receiver has such a size as to cover one of the four recording heads. A cap caps the four recording heads simultaneously. In addition, the ink receiver and the cap are arranged in parallel. The ink receiver is reciprocated along the arrangement direction integrally with or independently of the cap.

According to U.S. Pat. No. 5,483,267, when capping, the cap and the ink receiver are integrally moved so that the cap is located at a predetermined capping position. Further, when performing the purge operation, the ink receiver is moved independently of the cap to a position where ink ejected from the recording head is received.

SUMMARY OF THE INVENTION

However, when the ink receiver has such a size as to receive ink ejected from one recording head as disclosed in U.S. Pat. No. 5,483,267, in order to receive the ink ejected from all recording heads, the ink receiver needs to be moved for each recording head. Accordingly, when the purge operation is executed for all the recording heads, the purge operation cannot be executed at high speed.

Further, U.S. Pat. No. 5,483,267 discloses that when the purge operation is not executed, the ink receiver is arranged in parallel with the cap in a direction along the moving direction thereof. Therefore there is a problem in that the apparatus is increased in size in the moving direction of the ink receiver.

Under these circumstances, the invention has been made and provides an image forming apparatus, which can execute the purge operation so as to restore the ink ejection performance at high speed, and can downsize the entire apparatus including the ink receiving unit for receiving ink in the purge operation compactly.

According to one embodiment of the invention, an image forming apparatus includes a conveyance unit, a plurality of nozzles, a recording unit, a cap unit, a first moving mechanism, a first ink receiving unit and a second moving mechanism. The conveyance unit conveys a recording medium in a first direction. The nozzles eject ink toward the recording medium being conveyed by the conveyance unit. The recording unit includes a plurality of recording heads being arranged in parallel. Each recording head includes a nozzle formation surface formed with the nozzles. The cap unit is able to abut against the nozzle formation surface of each recording head to form a closed space in which the nozzle formation surface is sealed up. The first moving mechanism reciprocates the cap unit along a second direction crossing the first direction, between a capping position facing the nozzle formation surfaces and a non-capping position apart from the capping position. The first ink receiving unit has an ink receiving region larger than a region that all the nozzles of the recording heads occupy. The second moving mechanism reciprocates the first ink receiving unit along the second direction, between an ink receiving position facing the nozzle formation surfaces and an ink non-receiving position apart from the ink receiving position. When the first ink receiving unit is located at the ink non-receiving position, at least a part of the first ink receiving unit overlaps the cap unit, which is located at the non-capping position, as viewed from a direction intersecting the nozzle formation surface. When the cap unit is located at the capping position, the first ink receiving unit is located at the ink receiving position and overlaps the entire cap unit as viewed from the direction intersecting the nozzle formation surface.

According to this configuration, the first ink receiving unit has the region larger than the occupation region of all the nozzles as a region for receiving ink ejected from the nozzles. Thus, even when the purge operation is executed for the plurality of recording heads at once, ink ejected during the purge operation can be received once. Accordingly, the purge operation can be executed at high speed, as compared with the case where the purge operation is executed for the recording heads one by one.

Further, when the first ink receiving unit is located at the ink non-receiving position, at least the part of the first ink receiving unit overlaps the cap unit, which is located at the non-capping position, as viewed from the direction intersecting the nozzle formation surface. According to this configuration, the cap unit and the first ink receiving unit are intensively arranged in the second direction. Therefore, the image forming apparatus can be downsized.

DETAILED DESCRIPTION OF EMBODIMENTS OF THE INVENTION

Figure 1:
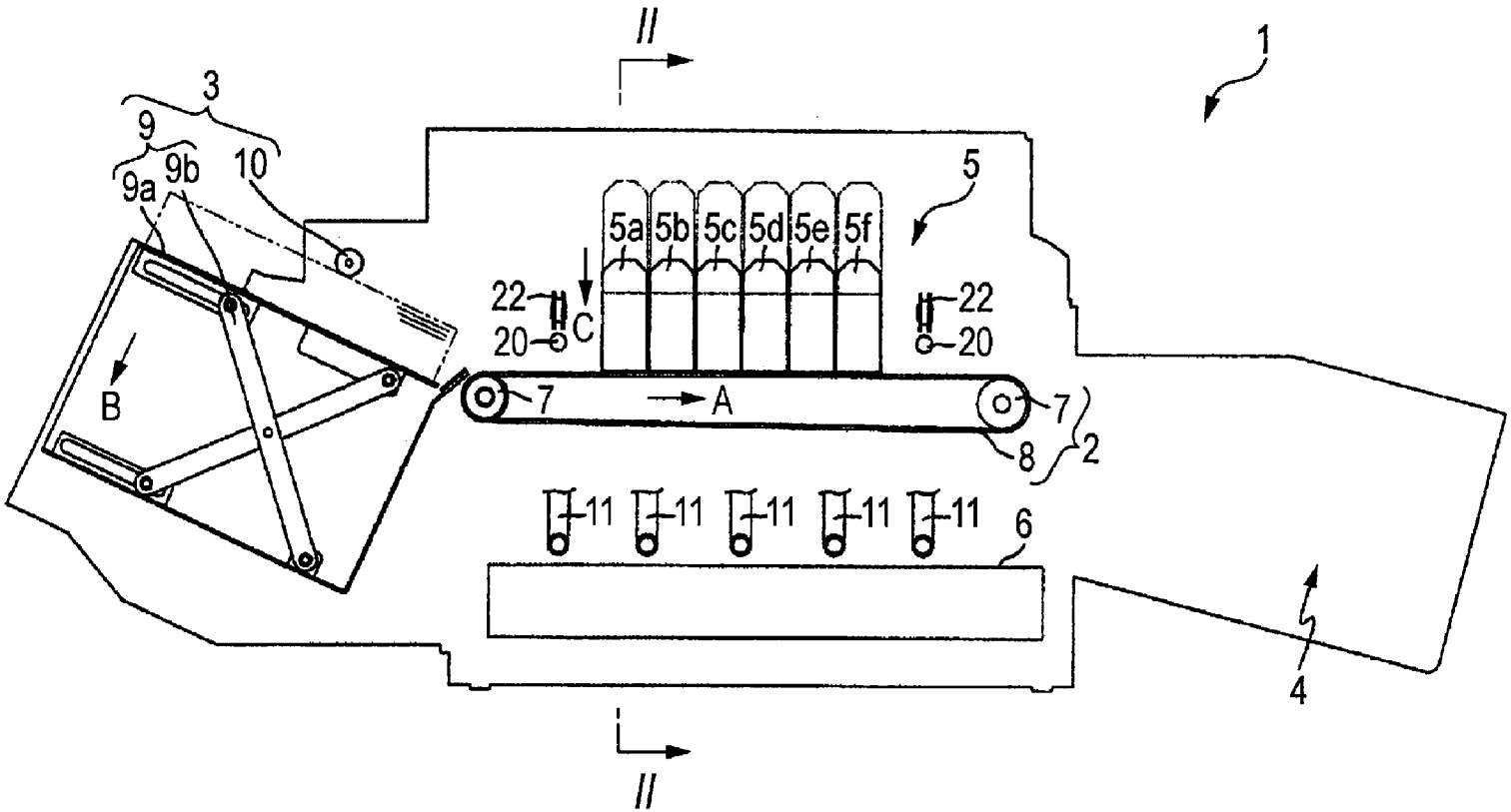
FIG. 1 is a diagram showing the internal configuration of an image forming apparatus.
Figure 2:
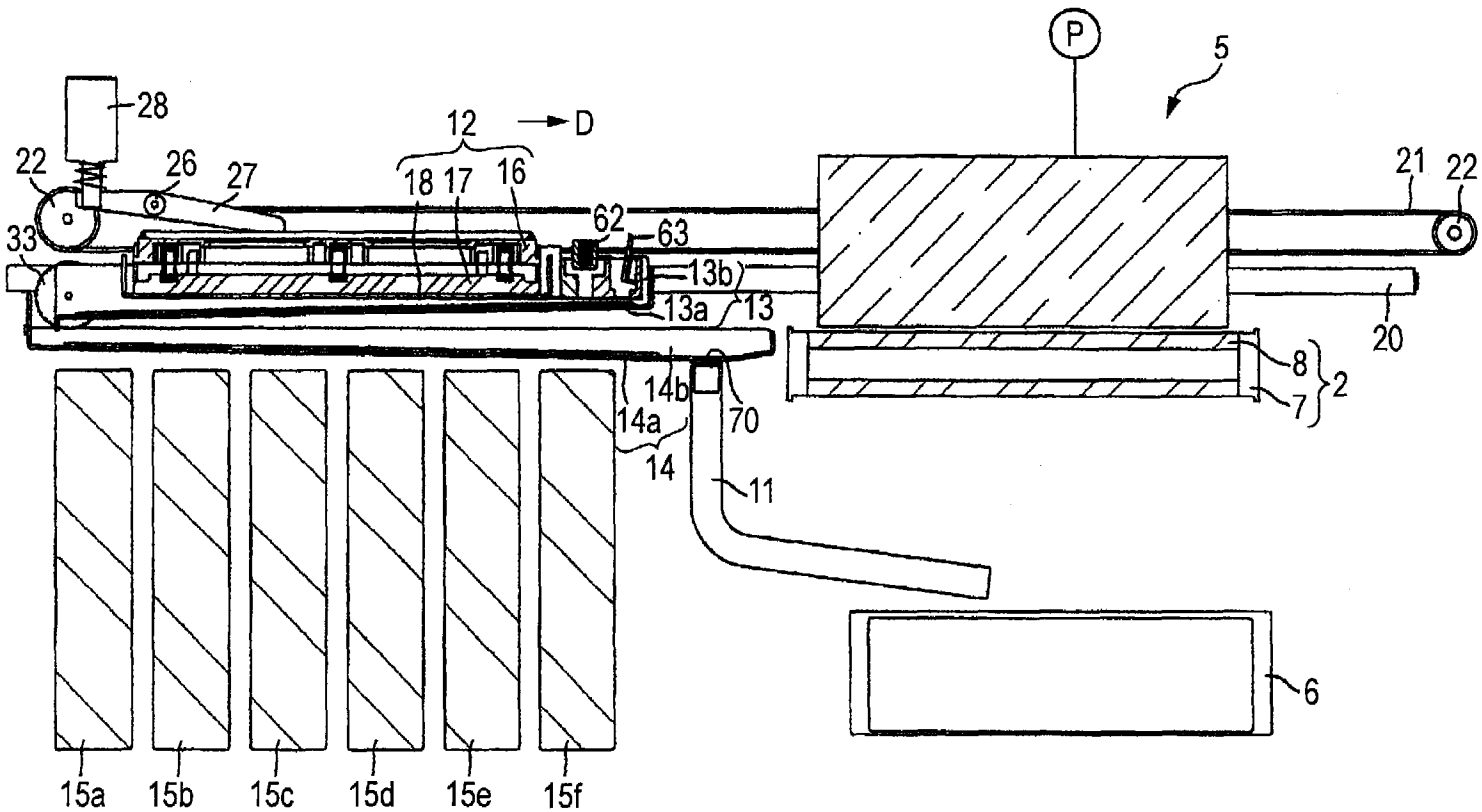
FIG. 2 is a cross-sectional view showing the internal configuration of the image forming apparatus 1 taken along a line II-II of FIG. 1.

Hereinafter, embodiments of the invention will be described with reference to the accompanying drawings. FIG. 1 is a diagram showing the internal configuration of an image forming apparatus 1 of this embodiment. The image forming apparatus 1 primarily has a conveyance unit 2, a paper feed unit 3, a paper discharging unit 4, a recording head unit 5 and a waste ink tank 6. The conveyance unit 2 conveys a recording medium in a direction of an arrow A. The paper feed unit 3 is disposed on an upstream side (the left side of FIG. 1) of the conveyance unit 2 and conveys the recording medium. The paper discharging unit 4 is disposed on a downstream side (the right side of FIG. 1) of the conveyance unit 2 with the conveyance unit 2 being interposed between the paper feed unit 3 and the paper discharging unit 4. The paper discharging unit 4 stores the recording medium conveyed by the conveyance unit 2. The recording head unit 5 is disposed above the conveyance unit 2 and ejects ink toward the recording medium being conveyed by the conveyance unit 2. The recording head unit 5 is connected to a pump P as shown in FIG. 2, and when the purge operation is performed, the pump P applies positive pressure to respective nozzles of the recording head unit 5 to eject a predetermined amount of ink together with dust and/or dried ink adhering to the nozzles. The waste ink tank 6 is disposed below the conveyance unit 2 with the conveyance unit being interposed between the waste ink tank 6 and the recording head unit 5. The waste ink tank 6 stores ink ejected during a purge operation through a tube 11. It is noted that the pump P is only shown in FIG. 2 and omitted in the other drawings. Moreover, other parts of the image forming apparatus 1 will be described below.

The conveyance unit 2 has a pair of conveyance rollers 7, which is disposed at a predetermined interval in the direction of the arrow A, and a conveyance belt 8, which has a predetermined width and is stretched between the pair of conveyance rollers 7. In the conveyance unit 2, if a conveyance motor 89 (see FIG. 12) is driven, one conveyance roller 7 of the pair of conveyance rollers 7 rotates rightward through a transfer mechanism (not shown) by driving force of the motor 89. The conveyance belt 8 and the other conveyance roller 7 rotate rightward accordingly. Then, the recording medium, which is conveyed from the paper feed unit 3 onto the conveyance belt 8, is conveyed in the direction of the arrow A, and finally is discharged to the paper discharging unit 4.

The paper feed unit 3 has a lift device 9 and a pickup roller 10, which is disposed above the lift device 9. The lift device 9 has a support plate 9*a* and arms 9*b*, which are connected to the support plate 9*a* so as to reciprocate the support plate 9*a* in a direction of an arrow B and a direction opposite to the arrow B.

The stacked recording media (see a two-dot-chain line in FIG. 1) are placed on the support plate 9*a*. If a lift motor 90 (see FIG. 12) is driven, the arms 9*b* move the support plate 9*a* such that the recording medium abut against the pickup roller 10. Then, the recording media are sequentially conveyed from an uppermost recording medium by the pickup roller 10, which rotates according to driving force of a pickup motor 91 (see FIG. 12).

The recording head unit 5 has six recording heads 5*a* to 5*f*, which correspond to ink of six colors of cyan, magenta, yellow, black, light cyan, and light magenta. The recording heads 5*a* to 5*f* are arranged in parallel along the conveyance direction A of the recording medium.

Further, nozzles for ejecting ink are formed in a surface (hereinafter, referred to as "nozzle formation surface") of each of the recording heads 5*a* to 5*f*, which faces the conveyance belt 8. The nozzles are arranged in a zigzag manner in a direction (from the front side of the paper of FIG. 2 toward its back side) perpendicular to the conveyance direction A of the recording medium. When ink is ejected from the nozzles, an image is formed on the recording medium being conveyed by the conveyance unit 2.

In addition, the recording heads 5*a* to 5*f* are connected integrally by a connection member (not shown). The connection member is movable vertically in a direction of an arrow C and a direction opposite to the arrow C. Accordingly, the recording heads 5*a* to 5*f* are movable vertically and integrally in the direction of the arrow C and the direction opposite to the arrow C.

That is, when an image is formed on the recording medium, the recording head unit 5 is located at a position close to the conveyance belt 8 (see a solid line of FIG. 1). Further, at the time of purge processing or capping, the recording head unit 5 is integrally moved from that position along the direction distant from the conveyance belt 8 (the direction opposite to the arrow C) (see the two-dot-chain line of FIG. 1). In addition, at the time of forming the image on the recording medium again, the recording head unit 5 is integrally moved in the direction of the arrow C so as to be located at the position close to the conveyance belt 8.

Also, the recording head unit 5 is of a so-called line head type. Specifically, the nozzle formation surface of each of the recording heads 5*a* to 5*f* has a larger length in a main scanning direction perpendicular to the conveyance direction A of the recording medium, than the maximum width of a recording medium, which the image forming apparatus 1 handles. Therefore, when forming an image on a recording medium being conveyed by the conveyance unit 2, the recording head unit 5 (the recording heads 5*a* to 5*f*) ejects ink onto the recording medium without moving in the main scanning direction unlike a serial-type recording head unit.

Figure 3:
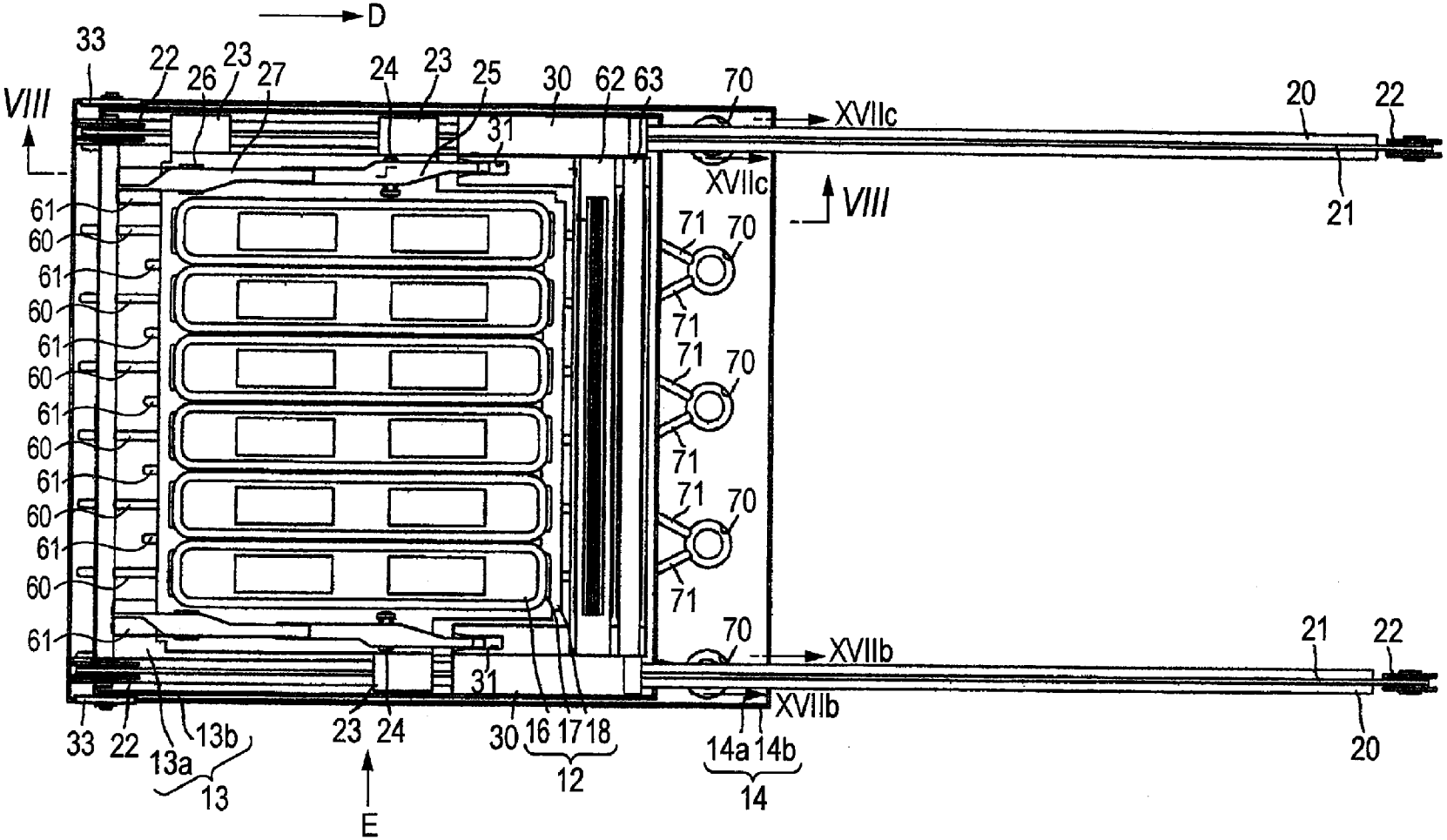
FIG. 3 is a plan view showing a cap unit, a first ink receiving unit, and a second ink receiving unit, which are in the state shown in FIG. 2.

Next, other parts of the image forming apparatus 1 will be described with reference to FIGS. 2 to 7. FIG. 2 is a cross-sectional view showing the internal configuration of the image forming apparatus 1 taken along a line II-II of FIG. 1. Moreover, an outer frame shown in FIG. 1 is not shown in FIG. 2. FIG. 3 is a plan view showing a cap unit 12, a first ink receiving unit 13 and a second ink receiving unit 14, which are in a state shown in FIG. 2.

Figure 4:
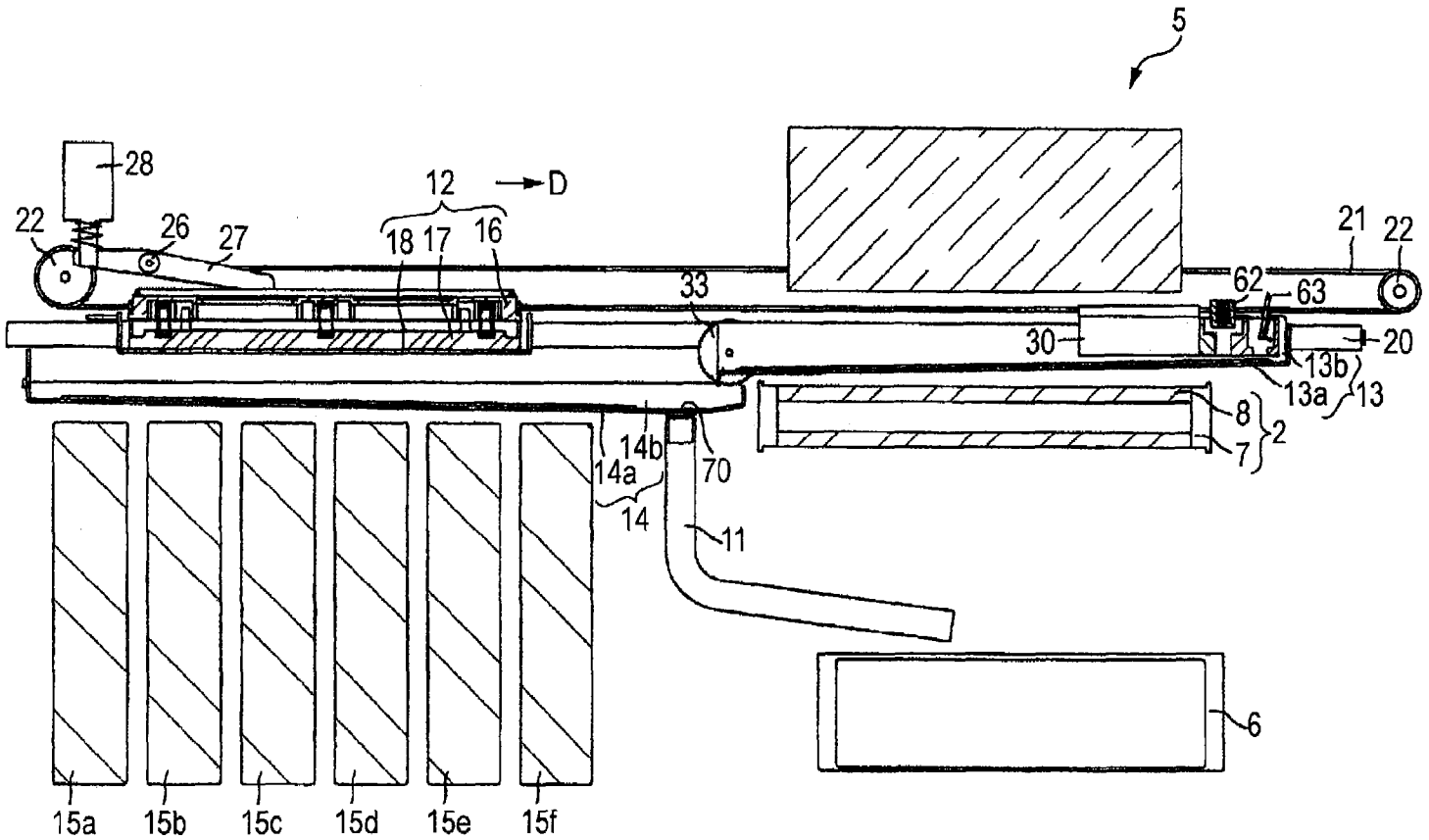
FIG. 4 corresponds to FIG. 2 and is a diagram showing a state where the first ink receiving unit, which is in the state shown in FIG. 2, is moved independently of the cap unit, toward a recording head unit 5.
Figure 5:
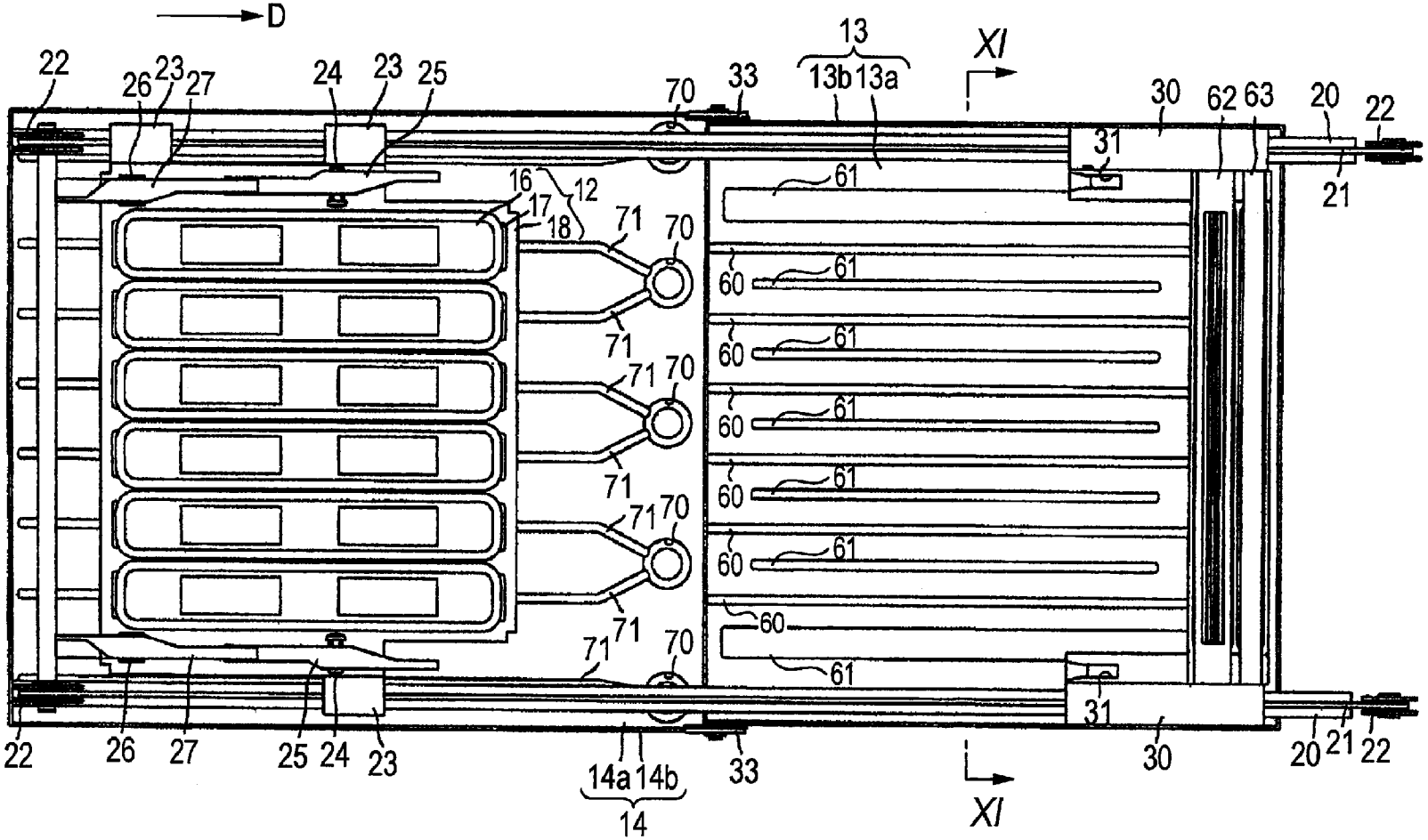
FIG. 5 is a plan view showing the cap unit, the first ink receiving unit, and the second ink receiving unit, which are in the state shown in FIG. 4.

FIG. 4 corresponds to FIG. 2 and is a diagram showing a state in which the first ink receiving unit 13, which is in the state shown in FIG. 2, is independently moved toward the recording head unit 5. FIG. 5 is a plan view showing the cap unit 12, the first ink receiving unit 13, and the second ink receiving unit 14, which are in the state shown in FIG. 4.

Figure 6:
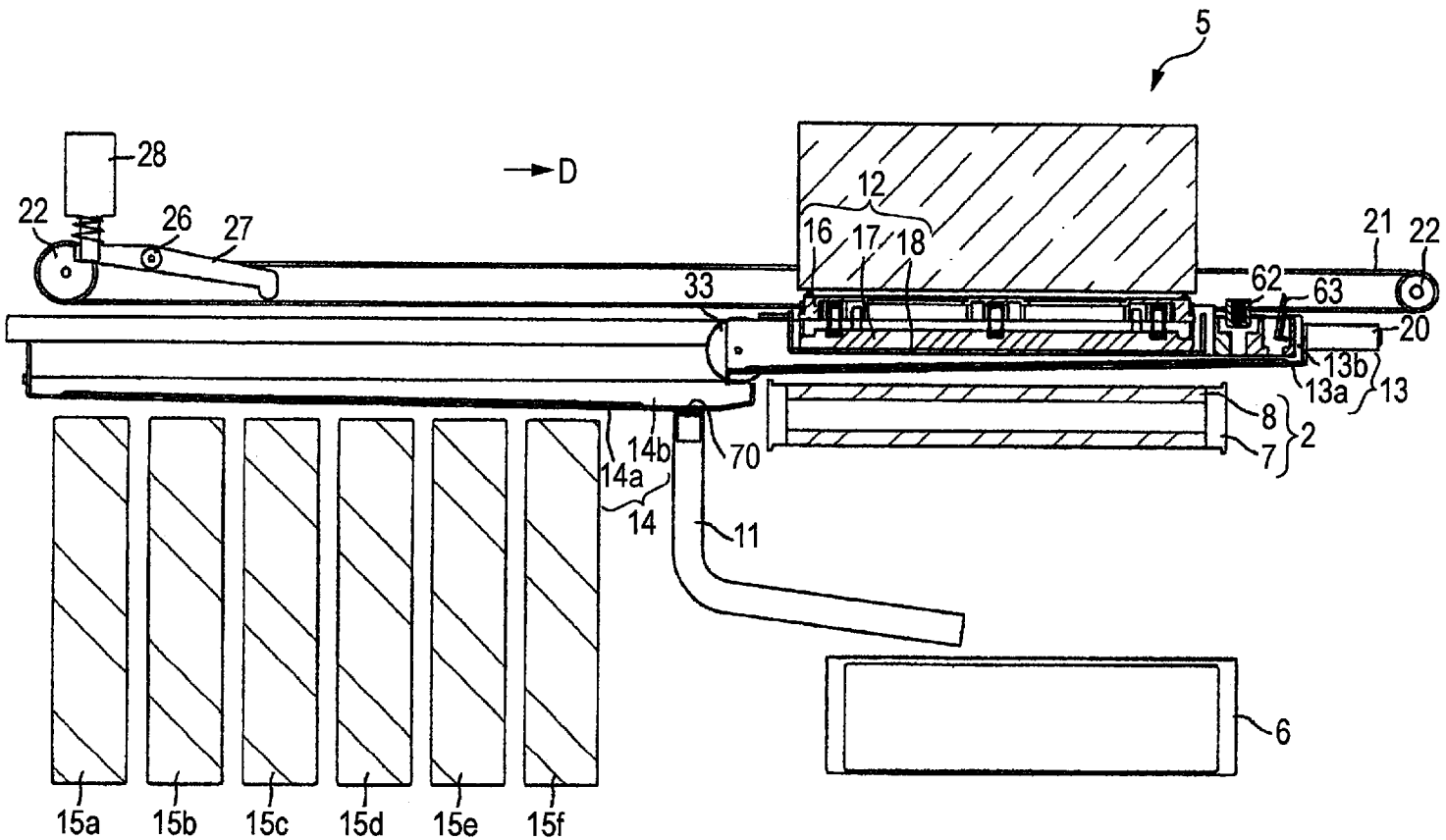
FIG. 6 corresponds to FIG. 2 and is a diagram showing a state where the cap unit, which is in the state shown in FIG. 2, is moved toward the recording head unit 5 integrally with the first ink receiving unit.
Figure 7:
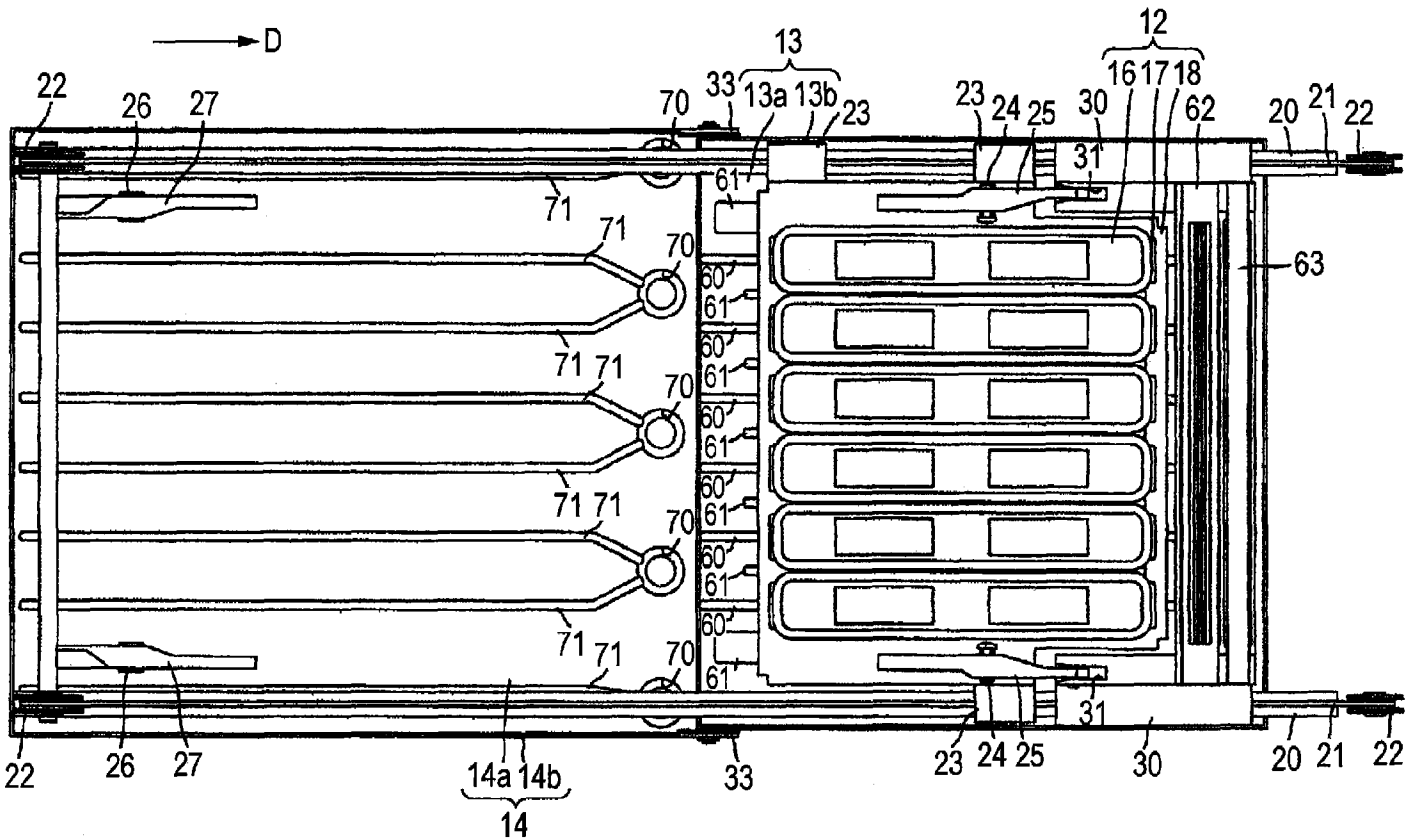
FIG. 7 is a plan view showing the cap unit, the first ink receiving unit, and the second ink receiving unit, which are in the state shown in FIG. 6.

FIG. 6 corresponds to FIG. 2 and is a diagram showing a state in which the cap unit 12, which is in the state shown in FIG. 2, is moved together with the first ink receiving unit 13 toward the recording head unit 5. FIG. 7 is a plan view showing the cap unit 12, the first ink receiving unit 13, and the second ink receiving unit 14, which are in the state shown in FIG. 6.

As shown in FIGS. 2 and 3, the image forming apparatus 1 has the cap unit 12, the first ink receiving unit 13, the second ink receiving unit 14, and six ink cartridges 15*a* to 15*f* beside the recording head unit 5 sequentially from the above, as well as the parts described with reference to FIG. 1.

The cap unit 12 abuts against the nozzle formation surface of each of the six recording heads 5*a* to 5*f* to form a closed space in which the nozzle formation surface is sealed off. The cap unit 12 has six cap main bodies 16, cap holders 17 and a cap tray 18. The cap main bodies 16 are arranged in parallel to correspond to the recording heads 5*a* to 5*f*. The cap holder 17 support the cap main bodies 16 while being spaced at predetermined intervals from the respective cap main bodies 16. The cap tray 18 supports the cap holders 17 from the below.

Further, the cap unit 12 can reciprocate between a non-capping position shown in FIGS. 2 to 5 and a capping position shown in FIGS. 6 and 7 in a direction of an arrow D (second direction), which is substantially perpendicular to the conveyance direction A (a first direction) of the recording medium (see FIG. 1), and a direction opposite to the arrow D (second direction) with being integrated with the first ink receiving unit 13. Moreover, the cap unit 12 will be described specifically below.

The first ink receiving unit 13 firstly receives ink, which is ejected from the recording heads 5*a* to 5*f* during the purge operation. The first ink receiving unit 13 is formed in a substantially hollow box shape with an opened top surface. The first ink receiving unit 13 includes a bottom wall 13*a* constituting an ink receiving region, and sidewalls 13*b* provided upright from edges of the bottom wall 13*a* toward the recording head unit 5.

Further, the first ink receiving unit 13 can reciprocate independently of the cap unit 12 between the ink non-receiving position shown in FIGS. 2, 3, 6, and 7 and an ink receiving position shown in FIGS. 4 and 5 in the direction of the arrow D and the direction opposite to the arrow D. Moreover, the first ink receiving unit 13 will be described specifically below.

The second ink receiving unit 14 receives ink flowing from the first ink receiving unit 13 and introduces the received ink into the waste ink tank 6 through the tube 11. As shown in FIGS. 2 and 3, the second ink receiving unit 14 is fixedly arranged below the first ink receiving unit 13, which is moved to the ink non-receiving position. Further, the second ink receiving unit 14 is formed in a substantially hollow box shape with an opened top surface, and includes a bottom wall 14*a* constituting an ink receiving region, and sidewalls 14*b* provided upright from the edges of the bottom wall 14*a* toward the recording head unit 5. Moreover, the second ink receiving unit 14 will be described specifically below.

The six ink cartridges 15*a* to 15*f* stores the ink of six colors of cyan, magenta, yellow, black, light cyan, and light magenta to be supplied to the respective six recording heads 5*a* to 5*f*. The ink cartridges 15*a* to 15*f* are detachably connected to the image forming apparatus 1. If the ink cartridges 15*a* to 15*f* are mounted on the image forming apparatus 1, the ink cartridges 15*a* to 15*f* are connected to pumps (not shown), and the six kinds of ink stored in the ink cartridges 15*a* to 15*f* are respectively supplied to the recording heads 5*a* to 5*f* through the tubes (not shown) by the pumps (not shown).

The image forming apparatus 1 includes two guide rods 20 and pulleys 22 as parts of a moving mechanism for reciprocating the cap unit 12 and the first ink receiving unit 13. The two guide rods 20 extend in the direction of the arrow D, which is substantially perpendicular to the conveyance direction A of the recording medium (see FIG. 1), on both sides of the recording head unit 5 while crossing the conveyance belt 8. The pulleys 22 are disposed above both ends of each of the two guide rods 20. A belt 21 is stretched between the pulleys 22 in the extension direction of each guide rod 20.

Figure 8:
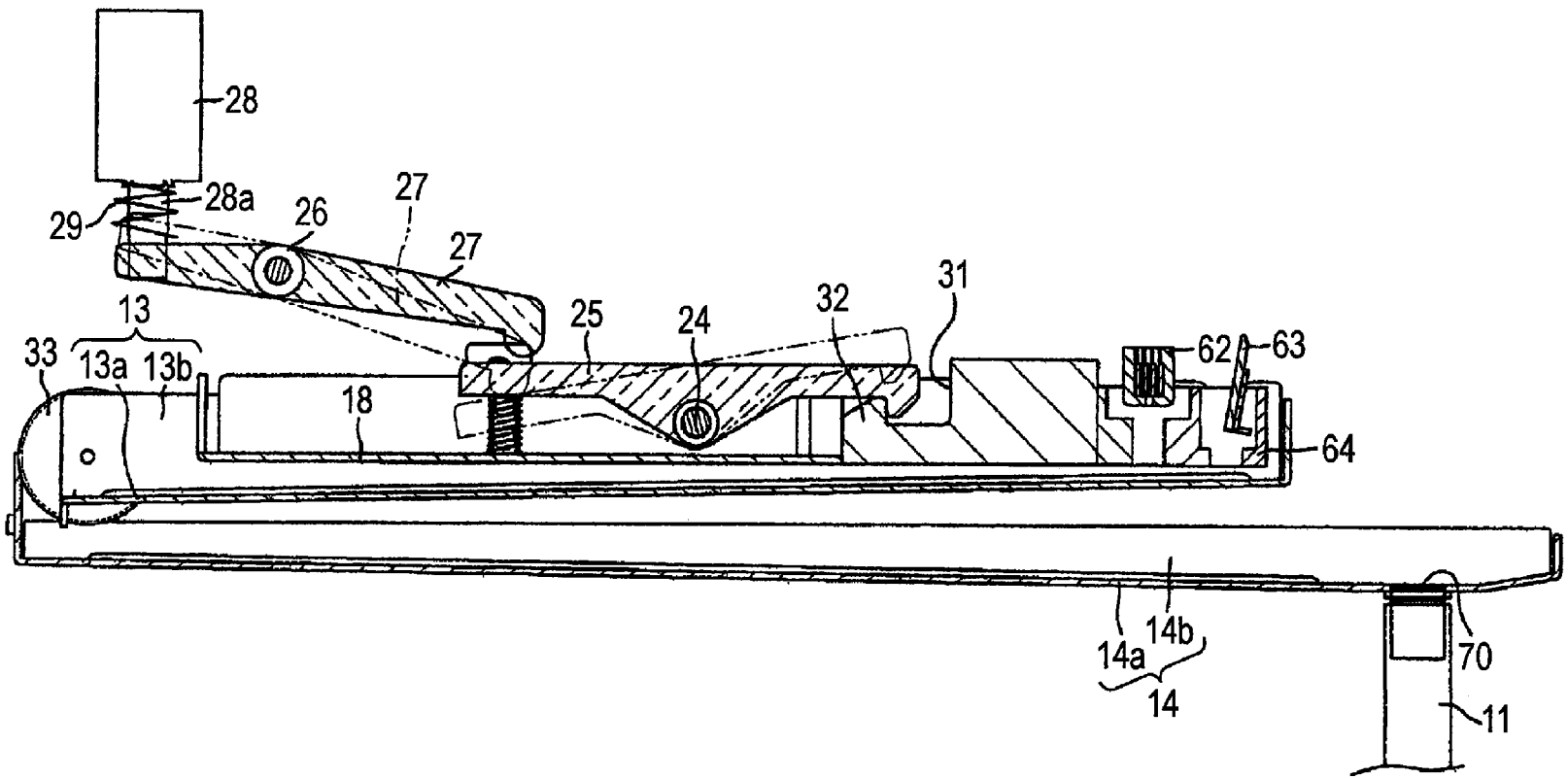
FIG. 8 is a cross-sectional view taken along a line VIII-VIII of FIG. 3.
Figure 17A:
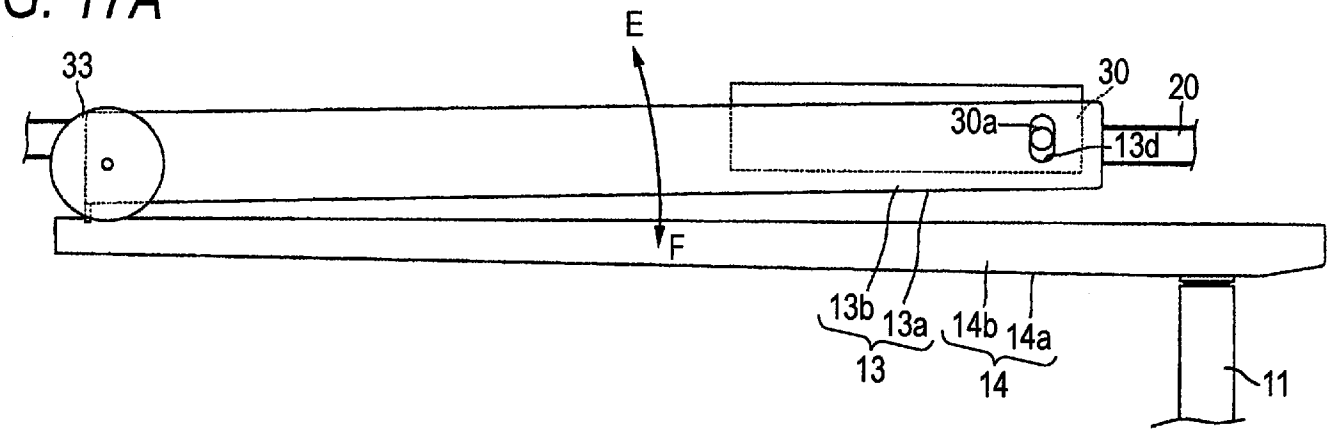
FIG. 17A is a schematic side view as viewed from a direction of an arrow E of FIG. 3.
Figure 17B:
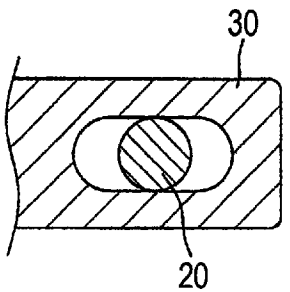
FIG. 17B is a cross-sectional view of a second support member 30 taken along a line XVIIb-XVIIb of FIG. 3.
Figure 17C:
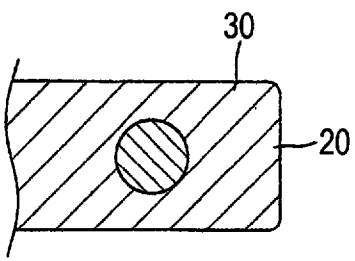
FIG. 17C is a cross-sectional view of the second support member 30 taken along a line XVIIc-XVIIc of FIG. 3.

Here, the moving mechanism for reciprocating the cap unit 12 and the first ink receiving unit 13 will be described with reference to FIGS. 2 to 8 and 17. FIG. 8 is a cross-sectional view taken along a line VIII-VIII of FIG. 3. Moreover, the guide rods 20, the pulleys 22, and the like are omitted in FIG. 8. FIG. 17A is a schematic side view as viewed from a direction of an arrow E of FIG. 3. FIG. 17B is a cross-sectional view of a second support member 30 taken along a line XVIIb-XVIIb of FIG. 3. FIG. 17C is a cross-sectional view of the second support member 30 taken along a line XVIIc-XVIIc of FIG. 3.

As shown in FIGS. 2, 3 and 8, first support members 23, though which the guide rods 20 pass loosely, are connected to the cap tray 18. The first support members 23 support the cap unit 12 including the cap tray 18 so that the cap unit 12 is in parallel with the nozzle formation surface of each of the recording heads 5*a* to 5*f*. The first support members 23 support the cap unit 12 at three points, that is, two points on both sides of a substantially central portion of the cap tray 18 and one point on a non-capping-position side of the cap tray 18. As such, by supporting the cap unit 12 at the three points, the cap unit 12 can be held in parallel with the nozzle formation surface of each of the recording heads 5*a* to 5*f*. Further, as described below, when the cap unit 12 is brought into close contact with the nozzle formation surface, airtightness can be improved.

Besides the first support members 23, two engaging claws 25 are provided at positions adjacent to the first support members 23 inside the cap tray 18 so as to be vertically movable like a simple balance around support shafts 24. Further, seesaw members 27 are provided at ends of the engaging claws 25 so as to be vertically movable like a simple balance around support shafts 26. In addition, solenoids 28 (see FIG. 8) are connected to ends of the seesaw members 27. On the other hand, the other ends of the engaging claws 25 are engaged with engaging grooves 31 formed in the second support members 30 described later.

The second support members 30 are connected to the ends of the side walls 13*b* of the first ink receiving unit 13 (on the recording head unit 5 side). The guide rods 20 pass through the second support members 30 loosely. The second support members 30 are connected to the belts 21. The second support members 30 support the first ink receiving unit 13 on an ink-receiving-position side of the corresponding first support member 23.

Here, how the second support members 30 support the first ink receiving unit 13 will be described with reference to FIGS. 17A to 17C. The second support members 30 are disposed inside the side walls 13*b* of the first ink receiving unit 13. A shaft 30*a* protrudes from each second support member 30 toward the corresponding side wall 13*b* of the first ink receiving unit 13.

On the other hand, long holes 13*d* are formed in the side walls 13*b* of the first ink receiving unit 13 so as to correspond to positions where the shafts 30*a* are provided. Each long hole 13*d* is formed in an elliptic shape elongating in a direction (vertical direction) in which the first ink receiving unit 13 and the cap unit 12 overlap each other. The shafts 30*a* are inserted into the long holes 13*d*, and thus the first ink receiving unit 13 is supported by the second support members 30. Further, wheels 33 are connected to the side walls 13*b* at positions opposite to positions of the side wall 13*b* to which the second support members 30 are connected. The wheels 33 can roll along upper edges of the side walls 14*b* of the second ink receiving unit 14. The first ink receiving unit 13 is supported by not only the second support member 30 but also the wheel 33.

As such, the first ink receiving unit 13 is supported so as to be movable in the direction (vertical direction) in which the first ink receiving unit 13 and the cap unit 12 overlap each other, with respect to the second support member 30. Accordingly, when the first ink receiving unit 13 reciprocates, a swing in the horizontal direction can be absorbed. The first ink receiving unit 13 is supported to be able to pivot with respect to the second support members 30 around fulcrums, which are contact points between the upper edges of the side walls 14*b* of the second ink receiving unit 30 and the wheels 33 (see a solid line of FIG. 17A). Therefore, when the first ink receiving unit 13 reciprocates, a swing in the vertical direction can be absorbed with a simple configuration. In addition, since the wheel 33 support the opposite side of the first ink receiving unit 13 to the second support member 30, the first ink receiving unit 13 can be stably supported.

Further, as shown in FIGS. 17B and 17C, one of the two second support members 30 is configured so that the guide rod 20 is passed with a clearance in the horizontal direction, and the other of the second support members 30 is configured so that the guide rod 20 is passed with no clearance. Since the guide rods 20 pass through the second support members 30 in this manner, for example, even when one of the guide rods 20 is distorted in the horizontal direction, the distortion can be absorbed by the clearance. As a result, the first ink receiving unit 13 can be smoothly moved. Moreover, the guide rods 20 pass through the first support members 23 as well as the second support members 30.

In this configuration, first, a mechanism for connecting the cap unit 12 and the first ink receiving unit 13 will be described. When the first ink receiving unit 13, which is located at the ink receiving position as shown in FIGS. 4 and 5, is moved to the ink non-receiving position shown in FIGS. 2 and 3, the bottom wall 13*a* of the first ink receiving unit 13 enters below the cap tray 18 located at the non-capping position. Then, the engaging claws 25 (see a solid line of FIG. 8), which are in the substantially horizontal state within the cap tray 18, collide with bank portions 32, which are provided in the first ink receiving unit 13 and adjacent to the engaging grooves 31.

Then, the engaging claws 25 are displaced to be inclined right upward in FIG. 8 around the support shafts 24 by collision force (see a two-dot-chain line of FIG. 8). The engaging claws 25 slide over the bank portions 32 so as to be engaged with the engaging grooves 31. As a result, since the engaging claws 25 are engaged with the engaging grooves 31, the cap unit 12 having the engaging claws 25 is connected to the first ink receiving unit 13 having the engaging grooves 31.

Next, a case in which the cap unit 12 and the first ink receiving unit 13, which are in a state where the cap unit 12 and the first ink receiving unit 13 are connected to each other by the engaging claws 25 and the engaging grooves 31 as shown in FIGS. 2 and 3, are integrally moved to the position shown in FIGS. 6 and 7 will be described. When the cap unit 12 and the first ink receiving unit 13 are in the state shown in FIGS. 2 and 3, if a slide motor 92 (see FIG. 12) is driven, the pulleys 22 and the belts 21 are rotated through a transfer mechanism (not shown).

Then, since the second support members 30 connected to the belts 21 are moved toward the recording head unit 5 along the guide rods 20, the first ink receiving unit 13 connected to the second support members 30 is also moved toward the recording head unit 5. Accordingly, the cap unit 12 connected to the first ink receiving unit 13 is integrally moved toward the recording head unit 5. Then, as shown in FIGS. 6 and 7, the cap unit 12 stops at the capping position, and the first ink receiving unit 13 stops at the ink receiving position. Moreover, when the first ink receiving unit 13 is moved, the wheels 33 roll along the upper edges of the side walls 14*b* of the second ink receiving unit 14, such that the first ink receiving unit 13 is moved stably.

Next, a case in which the first ink receiving unit 13 is moved to the ink receiving position independently of the cap unit 12 in a state where the cap unit 12 and the first ink receiving unit 13 are connected to each other by the engaging claws 25 and the engaging grooves 31 as shown in FIGS. 2 and 3 will be described.

In this case, first, the solenoids 28 is activated to disengage the engaging claws 25 and the engaging grooves 31. As shown in FIG. 8, when the solenoids 28 is not activated, the seesaw members 27 are substantially maintained in the horizontal state (see a solid line of FIG. 8) by coil springs 29 passing through connection rods 28*a* of the solenoids 28. In this state, if the solenoids 28 is activated, the connection rods 28*a* are displaced upward against the coil springs 29, and the seesaw members 27 connected to the connection rods 28*a* are displaced around the support shafts 26 to be inclined right downward (see a two-dot-chain line of FIG. 8). Then, the other ends of the seesaw members 27 press the one ends of the engaging claws 25. Thus, the engaging claws 25 are displaced around the support shafts 24 to be inclined right upward (see the two-dot-chain line of FIG. 8). Accordingly, the engaging claws 25 engaged with the engaging grooves 31 are disengaged from the engaging grooves 31.

If the slide motor 92 (see FIG. 12) is driven in this state in a similar manner to the above description, since the engaging claws 25 have been disengaged from the engaging grooves 31, only the first ink receiving unit 13 is moved along the guide rods 20, and finally stops at the ink receiving position shown in FIGS. 4 and 5.

This embodiment exemplary shows that a combination of the first ink receiving unit 13, the guide rods 20, the belts 21, the pulleys 22, the first support members 23, the engaging claws 25, the second support members 30, the engaging grooves 31 and the slide motor 92 functions as a first moving mechanism that reciprocates the cap unit 12 along the direction of the arrow D between the capping position and the non-capping position. Also, this embodiment exemplary shows that a combination of the guides rods 20, the belts 21, the pulleys 22, the second support members 30 and the slide motor 92 functions as a second moving mechanism that reciprocates the first ink receiving unit 13 along the direction of the arrow D between the ink receiving position and the ink non-receiving position. Since the first moving mechanism for moving the cap unit 12 and the second moving mechanism for moving the first ink receiving unit 13 share the guide rods 20 and the slide motor 92, the number of parts can be reduced. As a result, the cost of the image forming apparatus 1 can be reduced.

Figure 9A:
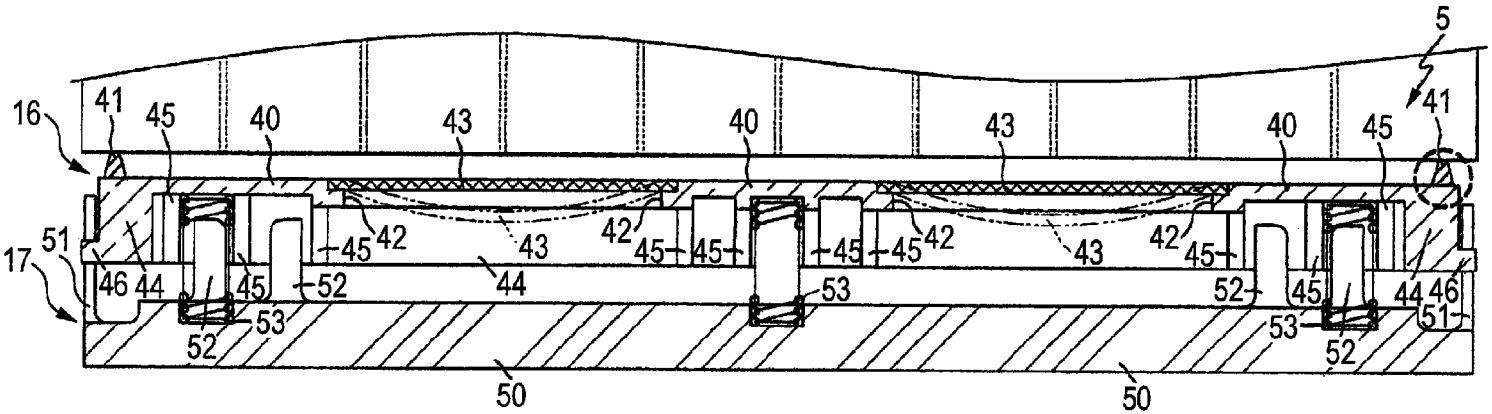
FIG. 9A is an enlarged cross-sectional view showing a state where lip portions of a cap main body abut against a nozzle formation surface.
Figure 9B:
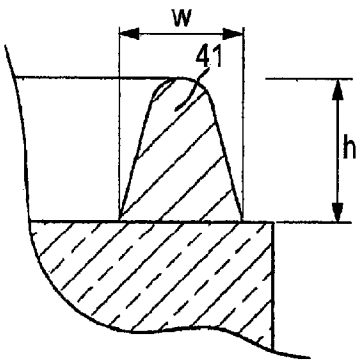
FIG. 9B is an enlarged cross-sectional view of the lip portion.
Figure 9C:
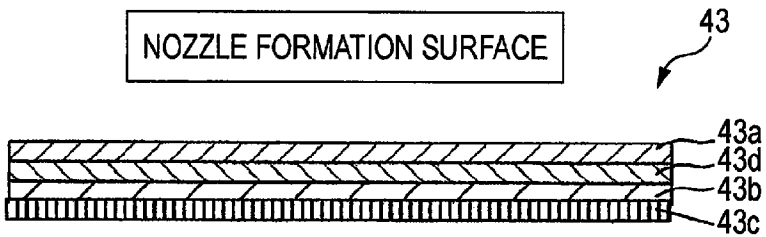
FIG. 9C is an enlarged cross-sectional view of a film.

Next, the cap unit 12 will be described in detail with reference to FIGS. 2 to 7, and 9. FIG. 9A is an enlarged cross-sectional view showing a state where the lip portions 41 of the cap main body 16 abut against the nozzle formation surface. FIG. 9B is an enlarged cross-sectional view of the lip portion 41. FIG. 9C is an enlarged cross-sectional view of a film 43. Moreover, in FIG. 9A, the cap tray 18 is not shown.

The six cap main bodies 16 arranged in parallel on the cap tray 18 are arranged to correspond to the recording heads 5*a* to 5*f*, in the same direction as the arrangement direction in which the recording heads 5*a* to 5*f* are arranged, and at the same pitch as the arrangement pitch of the recording heads 5*a* to 5*f*.

As shown in FIG. 9A, each cap main body 16 has a plate-shaped base portion 40, the lip portions 41, openings 42, films 43, vertical walls 44, reinforcing walls 45 and engagement portions 46. The base portion 40 faces the nozzle formation surface of each of the recording heads 5*a* to 5*f*. The lip portions 41 are upright from peripheral edges of the base portion 40 toward the nozzle formation surface to be able to abut against the nozzle formation surface. The openings 42 pass through and open the base portion 40. The films 43 cover the openings 42. The vertical walls 44 extend from the peripheral edges of the base portion 40 in a direction opposite to the direction in which the lip portions 41 are upright. The reinforcing walls 45 extend inward from the inner surfaces of the vertical walls 44. The engagement portions 46 extend outward from lower ends of the vertical walls 44 in a lateral direction so as to be engaged with the cap holder 17.

Among the parts constituting each cap main body 16, parts except the lip portions 41 and the films 43 are integrally formed of resin. The lip portions 41 are formed of resin having larger elasticity than these parts and are fixed to the base portion 40 by thermal welding. Specifically, the lip portions 41 are formed of rubber having JIS A hardness in a range of from about 10 degrees to about 20 degrees. According to these properties of the lip portions 41, when the lip portions 41 abut against the nozzle formation surface, the lip portions 41 can be in close contact with the nozzle formation surface. Thus, airtightness of the closed space for closing the nozzle formation surface can be enhanced. Therefore, when the image forming apparatus 1 is not used, ink in the nozzles can be suppressed from being dried.

Further, as shown in FIG. 9B, the respective lip portions 41 are formed in a hill shape having one apex in cross-sectional view. A curvature R of the apex is about 1.0 mm. According to this structure of the lip portions 41, the lip portions 41 can be in further close contact with the nozzle formation surface.

Further, the maximum height h of each lip portion 41 is in a range of from about 1.0 mm to about 2.0 mm, and preferably, about 1.5 mm. The maximum width w of each lip portion 41 is in a range of from about 1.5 mm to about 2.5 mm, and preferably, about 2.0 mm. That is, the maximum height h of the lip portion is about 0.75 to 2.5 times, preferably about 1.3 times, as large as the maximum width w of the lip portion.

According to this structure of the lip portions 41, a space surrounded by the nozzle formation surface, the base portion 40, and the lip portions 41 can be made as small as possible. Therefore, it is further possible to prevent the ink from the nozzles from being dried, as much as possible. Further, when the lip portions 41 abut against the nozzle formation surface, the lip portions 41 can be prevented from being toppled left and right. Thus, the lip portions 41 can stably abut against the nozzle formation surface.

The image forming apparatus 1 is of the line head type as described above. Each of the recording heads 5*a* to 5*f* of the line head type has a large number of nozzles. Therefore, the purge operation for the recording head unit 5 of the line head type requires a larger amount of ink than a serial type recording head, which has less number of nozzles. If the purge operation is often performed, a quite larger amount of ink would be wasted. According to the lip portions 41, the ink in the nozzles is prevented from being dried as much as possible as described above, decreasing the number of times that the purge operation is required and performed. As a result, an amount of ink wasted in the purge operation can be decreased.

Each cap main body 16 is provided with the two openings 42. The number of the openings 42, the positions of the openings 42, and the like are not limited to this embodiment. For example, a plurality of openings 42 may be scattered in the base portion 40. Further, the base portion 40 may be formed in a frame shape, and the entire inner portion of the frame may be formed as an opening.

As shown in FIG. 9C, each of the films 43 is formed by laminating four films of a nylon film 43*a*, an aluminum oxide layer 43*d*, a polyester film 43*b* on which the aluminum oxide 43*d* is deposited, and a polypropylene film 43*c* in order from the nozzle formation surface side.

Each of the films 43*a* to 43*c* is thin enough to have flexibility, and has gas barrier property. Further, the aluminum oxide 43*d* deposited on the polyester film 43*b* has high barrier property against vapor. Therefore, the film 43 has excellent shielding property against all kinds of gas and also has shielding property against any kind of ink, such as solvent-based ink or water-based ink. As such, by forming the film 43 to have the four-layered structure, a film having flexibility and gas shielding property can be simply implemented.

It is noted that the film 43 is not limited to a combination of the three layers 43*a* to 43*c* and the aluminum oxide 43*d*. The film 43 may have a lamination structure including at least one aluminum oxide layer 43*d* and another flexible layer. Also, the film 43 may have a plurality of aluminum oxide layers 43*d*.

In place of the aluminum oxide 43*d*, silicon oxide may be used. Both the aluminum oxide and the silicon oxide have high gas barrier property so long as they have at least a few Å in thickness.

The film 43 is welded to the base portion 40 so as to cover the openings 42. Thereby, in the case where the lip portions 41 abut against the nozzle formation surface (during capping), even if an internal pressure of the closed space defined by the nozzle formation surface, the base portion 40, and the lip portions 41, in which the nozzle formation surface is sealed off, is changed, the change in pressure can be absorbed by the films 43.

That is, before capping, the films 43 cover the openings 42 in plan view (see a solid line of FIG. 9A). After capping, the films 43 are made concave so as to be swelled toward an opposite side to the recording head unit 5 so that the change in pressure in the closed space is absorbed (see a two-dot-chain line of FIG. 9A).

As described above, the purge operation is performed by applying positive pressure to the respective nozzles of the recording heads 5*a* to 5*f*. In other words, the purge operation of this embodiment is a so-called "pressure purge." Therefore, it is not necessary to provide an incision in each film 43. To the contrary, a so-called "suction purge" requires a film to have an incision because the suction purge operation sucks through the incision of the film a closed space in which a nozzle formation surface is sealed off.

Further, even when an environmental temperature in surroundings is changed while the lip portions 41 abut against the nozzle formation surface (during capping), the internal pressure of the closed space is changed. However, like the above-described case, the change in pressure can be absorbed by the films 43. That is, when the environmental temperature rises, the films 43 are swelled toward the opposite side to the recording head unit 5 so as to absorb the change in pressure in the closed space. Further, when the environmental temperature falls, the films 43 are swelled toward the recording head unit 5 so as to absorb the change in pressure in the closed space. Accordingly, the meniscuses in the nozzles can be prevented from being damaged due to the change in pressure during capping. Thus, stable ink ejection performance can be maintained.

The films 43 have the gas shielding property for shielding gas. With this configuration, the ink is prevented from being dried due to gas, which transmits into the closed space in which the nozzle formation surface is sealed off and releasing a saturation state of the closed space.

The cap holder 17 has a plate-shaped substrate 50, a first erect walls 51 and second erect walls 52. The substrate is arranged at a position, which faces the base portion 40 of each cap main body 16 with a predetermined gap. The first erect walls 51 are upright toward the cap main body 16 from both ends of the substrate 50 in the width direction of the substrate 50. The first erect walls 51 have engagement holes for engaging with the engagement portions 46 of the cap main body 16. The second erect walls 52 are upright from the substrate 50 toward the cap main body 16, inside the first erect walls 51.

The cap main body 16 is placed on the first erect walls 51 with the predetermined gap from the substrate 50 while the engagement portions 46 of the cap main body 16 are inserted into the engagement holes of the first erect walls 51. Further, coil springs 53 are disposed between the base portions 40 of the cap main bodies 16 and the substrate 50. The coil springs 53 can absorb the pressure at the time of capping. The lip portions 41 can be pressed toward the nozzle formation surface, so that the lip portions 41 are in closer contact with the nozzle formation surface. In addition, the plurality of second erect walls 52 can prevent the cap main body 16 from being excessively pressed toward the substrate 50 at the time of capping.

In this exemplary embodiment, the three coil springs 53 support the base portion 40 of each cap main body 16 as shown in FIG. 9A. The total elastic force of the thee coil springs 53 is equal to 0.5 kgf. When capping the nozzle formation surface, each cap main body 16 (the lip portions 41) is stably pressed against the nozzle formation surface by the force of 0.5 kgf given by the tree coil springs 53.

On the other hand, the meniscus in the nozzles are destroyed with about 5 kPa or more. Assuming that the total elastic force of the three coil springs 53 is too great. In this case, the cap unit 12 does not open the closed space defined by the nozzle formation surface, the lip portions 41 and the base portion 40 during capping in which the nozzle formation surface is sealed off even if the inner pressure of the closed space exceeds 5 kPa. As a result, the meniscus in the nozzles would be destroyed due to the excess inner pressure of the closed space, necessitating the purge operation. In order to avoid such destruction of the meniscus due to the increased inner pressure of the closed space and avoid the purge operation, which wastes ink, the total elastic force of the three coil spring 53 is set to 0.5 kgf in the exemplary embodiment. In other words, the total elastic force of the coil springs 53 of the cap unit 12 is less than force, which the bottom surfaces of the cap main bodies 16 receive when the inner pressure of the closed space destroys the meniscus in the nozzles.

Specifically, each cap main body 16 has 124 mm (length)× 19 mm (width)×2 mm (depth). When the inner pressure of the closed space reaches 5 kPa, the base portion 40 and the films 43 receive force of about 1.20 kgf from the nozzle formation surface side. The total elastic force of the three coil spring 53, that is, 0.5 kgf is less than 1.20 kgf. Therefore, before reaching 5 kPa, the inner pressure of the closed space moves the cap main bodies 16 downward against the elastic force given by the three coil springs 53. As a result, the exemplary embodiment can avoid that the meniscus in the nozzles are destroyed in the case where the inner pressure of the closed space increases excessively during capping.

Figure 10:
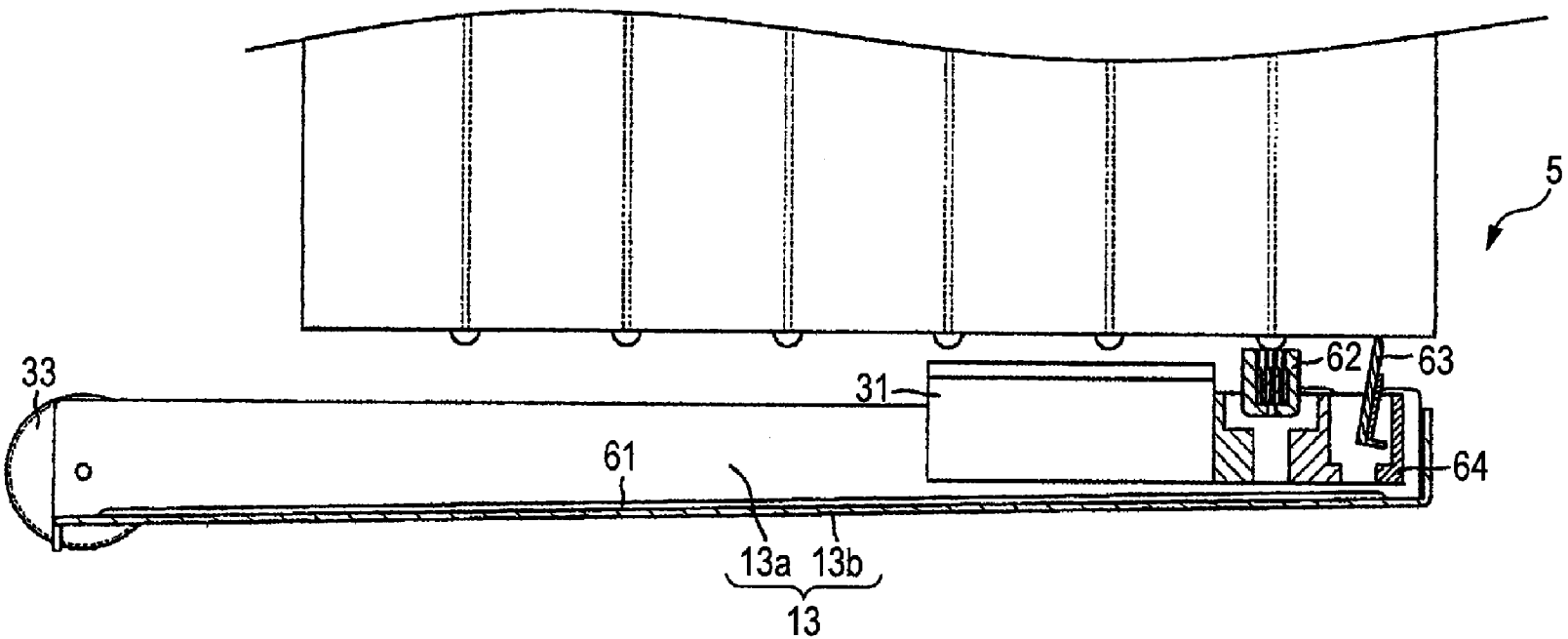
FIG. 10 is a cross-sectional view showing the first ink receiving unit, which is facing the recording head unit.
Figure 11:
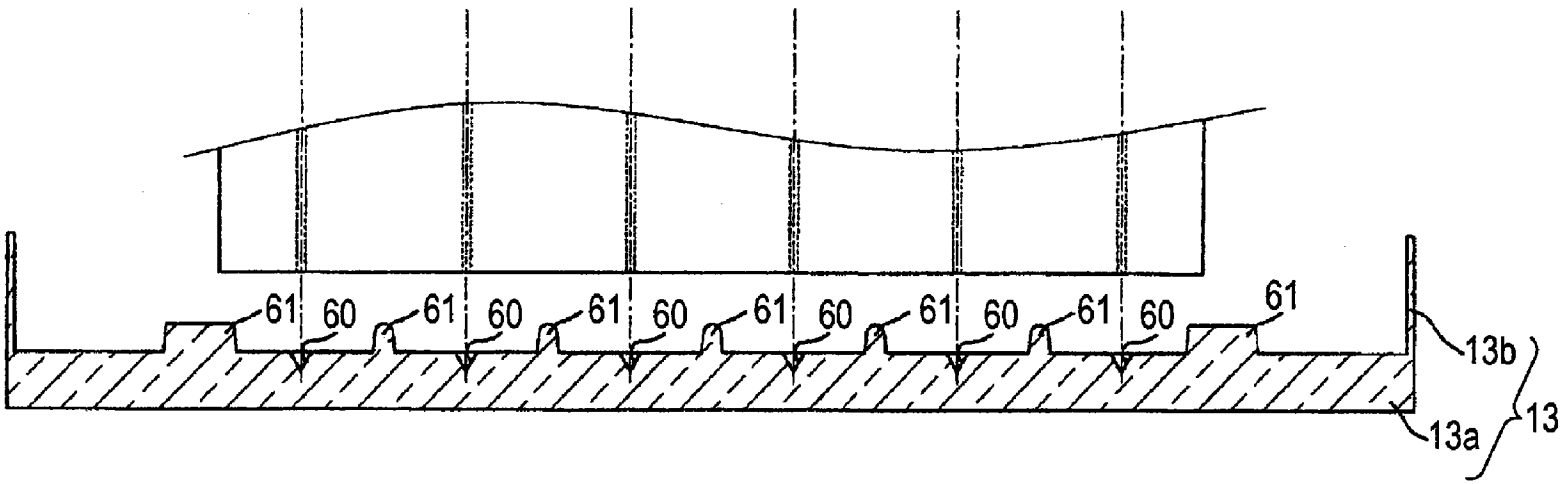
FIG. 11 is an enlarged cross-sectional view of the first ink receiving unit taken along a line XI-XI of FIG. 5.

Next, the first ink receiving unit 13 will be described in detail with reference to FIGS. 2 to 7, 10, and 11. FIG. 10 is a cross-sectional view of the first ink receiving unit 13, which is facing the recording head unit 5 (the first ink receiving unit 13 is located at the ink receiving position). FIG. 11 is an enlarged cross-sectional view of the first ink receiving unit 13 taken along a line XI-XI of FIG. 5.

The bottom wall 13*a* of the first ink receiving unit 13 is larger than a region that the nozzles provided in the nozzle formation surfaces of the respective recording heads 5*a* to 5*f* occupy. That is, even if ink is ejected from all nozzles of the respective recording heads 5*a* to 5*f* when the first ink receiving unit 13 is located at the ink receiving position, the bottom wall 13*a* of the first ink receiving unit 13 is configured to have such a size as to be able to receive ink ejected from the all nozzles.

Accordingly, the purge operation can be executed for the respective recording heads 5*a* to 5*f* at once. Thus, the purge operation can be executed at high speed, as compared with a case where the purge operation is executed for one recording head at a time.

Further, as shown in FIG. 3, the bottom wall 13*a* of the first ink receiving unit 13 is configured to have such a size as to overlap the entire cap unit 12, which is located at the non-capping position, as viewed from a direction crossing the nozzle formation surface when the first ink receiving unit 13 is located at the ink non-receiving position. Accordingly, the first ink receiving unit 13, which is located at the ink non-receiving position, and the cap unit 12, which is located at the non-capping position, can be disposed compactly in the depth direction (the direction of the arrow D) of the image forming apparatus 1. As a result, the image forming apparatus 1 can be downsized.

Further, the bottom wall 13*a* of the first ink receiving unit 13 is inclined downward from the ink receiving position toward the ink non-receiving position. Therefore, ink ejected by the purge operation onto the bottom wall 13*a* of the first ink receiving unit 13 located at the ink receiving position can smoothly flow toward the second ink receiving unit 14.

In addition, as shown in FIGS. 5, 10, and 11, six grooves 60 and seven ribs 61 are formed on the bottom wall 13*a*. The grooves 60 are depressed from the surface of the bottom wall 13*a*. The ribs 61 protrude from the surface of the bottom wall 13*a* to be disposed across the corresponding groove 60 from each other.

The grooves 60 causes ink ejected from the respective recording heads 5*a* to 5*f* to flow toward the second ink receiving unit 14. The grooves 60 extend substantially linearly along the moving direction of the first ink receiving unit 13. Further, as shown in FIG. 11, the sectional shape of each groove 60 is substantially a V shape. According to this structure of the grooves 60, ink can be rapidly flown due to capillary force generated in ink flowing into the grooves 60. Further, the section shape of each of the grooves 60 is substantially formed in a V shape. Therefore, stronger capillary force can be generated in the bottom portions of the grooves, as compared with a case where the grooves 60 are substantially formed in U shapes, and thus ink can be smoothly flown.

Further, as shown in FIG. 11, in a state where the first ink receiving unit 13 has been moved to the ink receiving position, the grooves 60 are located just below the nozzles provided in the respective recording heads 5*a* to 5*f*. Accordingly, ink is ejected from the nozzles onto the grooves 60, and thus the ejected ink can flow smoothly along the grooves 60.

The ribs 61 guide ink ejected from the respective recording heads 5*a* to 5*f* into the predetermined groove 60, and extend linearly along the moving direction of the first ink receiving unit 13 so as to be disposed across the groove 60 from each other. The ribs 61 can prevent ink from leaking into adjacent grooves 60. That is, ink can be prevented from being concentrated on a particular groove 60.

The side walls 13*b* of the first ink receiving unit 13 are upright from three sides of the bottom wall 13*a*, that is, an edge of the bottom wall 13*a* close to the ink receiving position and edges of the bottom wall 13*a* along the two guide rods 20. In other words, the side walls 13*b* of the first ink receiving unit 13 are upright from the edges of the bottom wall 13*a* except an edge of the bottom wall 13*a* close to the ink non-receiving position.

Accordingly, ink ejected onto the bottom wall 13*a* by the purge operation can be prevented from leaking from the side close to the ink receiving position or the sides extending along the guide rods 20, and can flow toward the ink non-receiving position.

Further, a region of the bottom wall 13*a* of the first ink receiving unit 13, excluding the grooves 60, is coated with a water-repellent film. That is, that region has better water-repellent property than a region where the grooves 60 are formed. Accordingly, ink ejected onto the bottom wall 13*a* of the first ink receiving unit 13 can be rapidly collected into the grooves 60, and thus ink can be rapidly flown.

The first ink receiving unit 13 is provided with, in addition to the parts described above, a comb-shaped ink introducing member 62 and a wiper 63. The ink introducing member 62 is disposed on a front-end side close to the ink receiving position. The wiper 63 is disposed closer to the ink receiving position than the ink introducing member 62.

The ink introducing member 62 introduces ink, which adheres to the nozzle formation surface of each of the recording heads 5*a* to 5*f* by the purge operation, onto the bottom wall 13*a*. The ink introducing member 62 forms a comb-shaped channels, which communicate the recording head unit 5 side with the bottom wall 13*a* side and extend over the range of the recording heads 5*a* to 5*f* in a direction perpendicular to the moving direction of the first ink receiving unit 13.

As shown in FIG. 10, in order to introduce ink adhering to the recording head 5*a* into the first ink receiving unit 13, the passage is formed so as to extend from a position spaced with a predetermined gap from the nozzle formation surface toward the first ink receiving unit 13.

Both ends of the ink introducing member 62 are fixed to the second support members 31. Therefore, as described above, when the second support members 31 reciprocate, the ink introducing member 62 also reciprocates along with the second support members 31. The ink introducing member 62 is not configured to be vertically movable or pivotable with respect to the second support members 31 as the first ink receiving unit 13 does. However, since the ink introducing member 62 is fixed to the second support members 31, the ink introducing member 62 can be held so as to be spaced with the predetermined gap from the nozzle formation surface, regardless of the movement of the first ink receiving unit 13.

According to the ink introducing member 62, as shown in FIG. 10, ink of a droplet shape adhering to the nozzle formation surface by the purge operation is introduced into the channels formed between the comb teeth by a capillary action when the first ink receiving unit 13 is moved in the direction opposite to the arrow D, and then is introduced onto the bottom wall 13*a* through the channels. Accordingly, the ink of the droplet shape adhering to the nozzle formation surface by the purge operation is removed. Therefore, the inside of the apparatus can be prevented from being polluted due to ink dripping into the apparatus.

The wiper 63 is able to abut against the nozzle formation surface so as to wipe ink adhering to the nozzle formation surface. When the first ink receiving unit 13 is moved from the ink receiving position to the ink non-receiving position, the wiper 63 is upright toward the nozzle formation surface so as to abut against the nozzle formation surface. The wiper 63 is formed of a rubber plate.

Like the ink introducing member 62, the wiper 63 is upright over a region corresponding to the recording heads 5*a* to 5*f* in the direction perpendicular to the moving direction of the first ink receiving unit 13. Further, the wiper 63 is detachably mounted on a base member 64. Both ends of the base member 64 are fixed to the second support members 30. Therefore, like the ink introducing member 62, the wiper 63 can also be held so as to be spaced with a predetermined gap from the nozzle formation surface, regardless of the movement of the first ink receiving unit 13.

According to the wiper 63, ink adhering to the nozzle formation surface, which has not been removed by the ink introducing member 62, can be wiped by a front end of the wiper 63 abutting against the nozzle formation surface when the first ink receiving unit 13 is moved in the direction opposite to the arrow D. Moreover, ink wiped by the wiper 63 flows downward along the wiper 63 and flows onto the bottom wall 13*a*. Accordingly, ink, which has not been removed by only the ink introducing member 62, can be removed.

Next, the second ink receiving unit 14 will be described in detail with reference to FIGS. 2 to 7. As shown in FIG. 3, in a state where the first ink receiving unit 13 is located at the ink non-receiving position, the bottom wall 14*a* of the second ink receiving unit 14 is configured to have such a size as to overlap the entire bottom wall 13*a* of the first ink receiving unit 13 as viewed from the direction intersecting the nozzle formation surface. Accordingly, the first ink receiving unit 13, which is located at the ink non-receiving position, and the second ink receiving unit 14 are arranged compactly in the depth direction (the direction of the arrow D) of the image forming apparatus 1. As a result, the image forming apparatus 1 can be downsized.

Further, as shown in FIG. 5, connection holes 70 passing through the bottom wall 14*a* are formed in the bottom wall 14*a* of the second ink receiving unit 14. The connection holes 70 introduces ink, which flows from the bottom wall 13*a* of the first ink receiving unit 13 onto the bottom wall 14*a* of the second ink receiving unit 14, into the waste ink tank 6 through the tube 11.

As shown in FIG. 5, the connection holes 70 are arranged on the front-end side of the bottom wall 14*a* in the direction along the guide rods 20 and on extension lines of the grooves 60 of the first ink receiving unit 13, which has been moved to the ink receiving unit. At this time, an end of the first ink receiving unit 13, which has been moved to the ink receiving position, on the ink-non-receiving-position side is located above the connection holes 70. By arranging the connection holes 70 in those positions, part of ink flowing to the second ink receiving unit 14 through the grooves 60 of the first ink receiving unit 13 can directly flow into the connection holes 70. Therefore, ink can be rapidly introduced into the connection holes 70. Further, as shown in FIG. 4, since the bottom wall 14*a* is inclined downward toward the connection holes 70, ink on the bottom wall 14*a* can be smoothly introduced into the connection holes 70.

In addition, as shown in FIG. 5, grooves 71, which extend substantially linearly from the connection holes 70 along the extension direction of the guide rods 20 and are depressed from the surface of the bottom wall 14*a*, are formed in the bottom wall 14*a*. The grooves 71 introduce ink, which flows onto the bottom wall 14*a*, into the connection holes 70. Like the grooves 60 formed in the first ink receiving unit 13, each of the grooves 71 has a substantial V shape in a cross section. Accordingly, ink can be smoothly introduced into the connection holes 70.

Further, a region of the bottom wall 14*a* of the second ink receiving unit 14, excluding the grooves 71 and the connection holes 70, is coated with a water-repellent film. That is, that region has better water-repellent property than a region where the grooves 71 and the connection holes 70 are formed. Accordingly, ink flowing into the bottom wall 14*a* of the second ink receiving unit 14 can be rapidly collected in the grooves 71 and the connection holes 70. Thus, ink can be rapidly discarded.

As such, in addition to the first ink receiving unit 13, the second ink receiving unit 14 is thus configured and arranged. For example, if the second ink receiving unit 14 is not provided, it is conceivable that an ink absorbing member is provided in the first ink receiving unit 14 in order to absorb the ink ejected from the nozzles in the purge operation. However, in this case, since absorbed ink increases the weight of the ink absorbing member, the movement speed of the first ink receiving unit 13 would be decreased. As a result, the purge operation could not be performed at high speed. In order to solve the problem caused in the above case, it is further conceivable that a tube may be connected to the first ink receiving unit, and that ink may be directly discharged from the tube to the waste ink tank 6. In this case, however, since the first ink receiving unit 13 is configured to reciprocate, the connected tube may be disconnected. To the contrary, since the fixed second ink receiving unit 14 is provided, ink ejected onto the first ink receiving unit 13 flows to the second ink receiving unit. Thus, the occurrence of the above-described problems can be prevented.

According to the above structure, the surface of the second ink receiving unit 14, into which the ink flows from the first ink receiving unit 13, is formed with the connection holes 70 communicating with the waste ink tank 6 having a large capacity. Therefore, a large amount of waste ink can be dealt with irrespective of the capacity of the second ink receiving unit 14.

Also, upper edges of the side walls 14*b* of the second ink receiving unit 14 function as rails on which the wheels 33 roll. Since this structure eliminates the necessity for providing other rails, the number of parts of the image forming apparatus 1 can be reduced.

Figure 12:
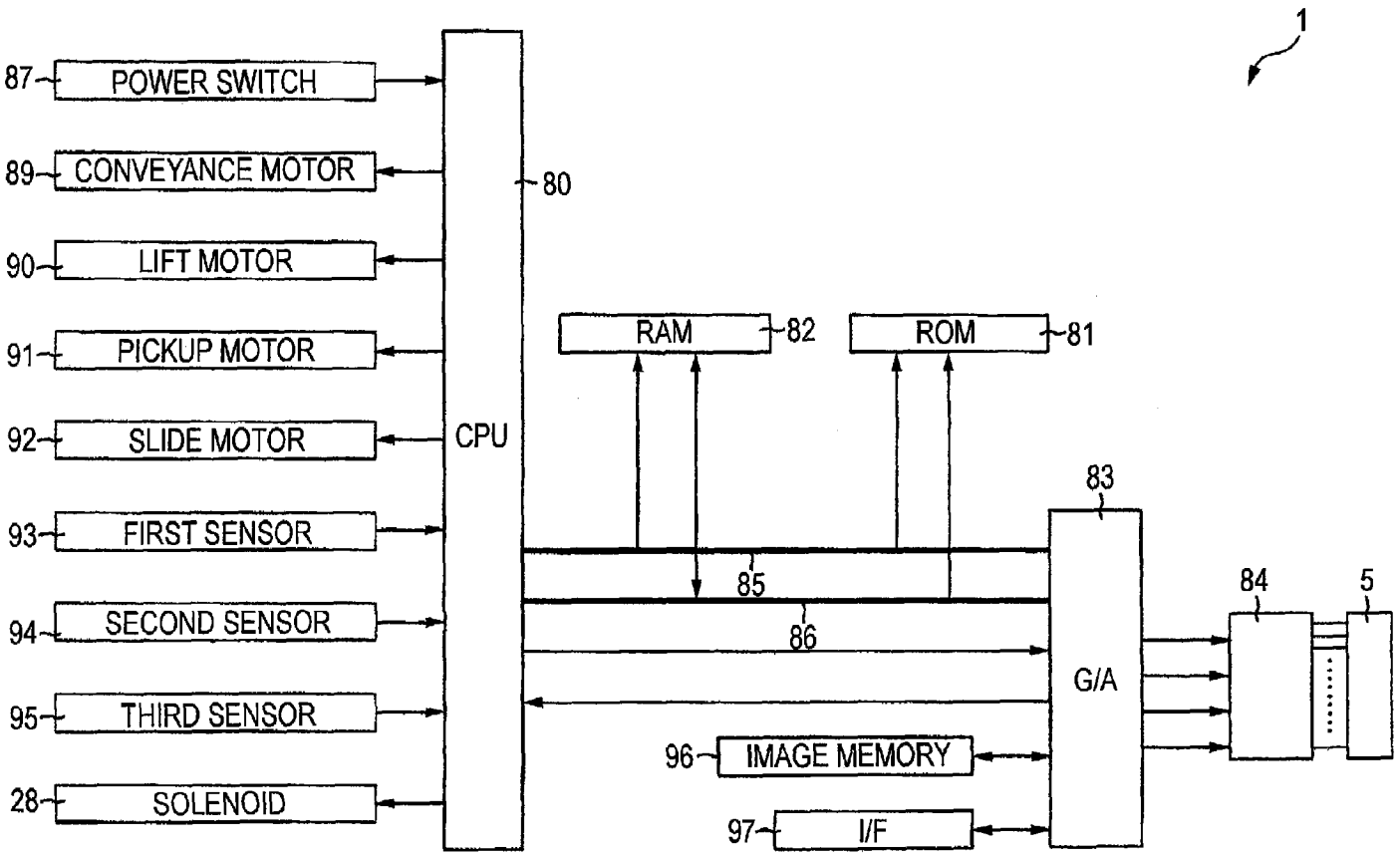
FIG. 12 is a block diagram showing the electrical configuration of the image forming apparatus.

Next, the electrical configuration of the image forming apparatus 1 will be described with reference to FIG. 12. FIG. 12 is a block diagram showing the electrical configuration of the image forming apparatus 1.

On the image forming apparatus 1, an one-chip micro computer (CPU) 80, a ROM 81, a RAM 82, a gate array (G/A) 83, a head driver 84, and the like are mounted. Moreover, the CPU 80, the ROM 81, the RAM 82, the gate array 83, and the head driver 84 are connected to one another through an address bus 85 and a data bus 86.

The CPU 80 serving as an arithmetic device executes controls of detecting, for example, ejection timing of ink, a residual quantity of ink and presence/absence of ink in the ink cartridge, according to a control program stored in the ROM 81 in advance. Further, the CPU 80 generates an ink ejection timing signal and a reset signal, and transmits these signals to the gate array 83 described below.

Further, a power switch 87, the conveyance motor 89, a lift motor 90, a pickup motor 91, a slide motor 92, first to third sensors 93-95 and the solenoid 28 are connected to the CPU 80. The power switch 87 supplies or cuts off power to the image forming apparatus 1. The conveyance motor 89 serves as a driving source for driving the conveyance rollers 7. The lift motor 90 serves as a driving source for driving the lift device 9. The pickup motor 91 serves as a driving source for driving the pickup roller 10. The slide motor 92 serves as for driving the first ink receiving unit 13. The CPU 80 controls the operation of each device.

The first sensor 93 detects whether or not the cap unit 12 is located at the non-capping position. The second sensor 94 detects whether or not the first ink receiving unit 13 is located at the ink non-receiving position. The third sensor 95 detects whether or not the first ink receiving unit 13 (the cap unit 12) is located at the ink receiving position. The CPU 80 monitors the output of each sensor to thereby check the state of the cap unit 12 and the like. Further, since the CPU 80 monitors the output of each sensor, for example, when the first ink receiving unit 13 is not located at the ink receiving position, ink is prevented from being ejected from the nozzles. Thus, the inside of the apparatus can be prevented from being polluted.

The ROM 81 is a non-rewritable nonvolatile memory, and stores various control programs for controlling the ejection of ink droplets to be executed by the CPU 80, and fixed-value data. The RAM 82 is a rewritable volatile memory, and temporarily stores various kinds of data or the like.

On the basis of image data stored in an image memory 96, the gate array 83 outputs image data (driving signals) for recording the stored image data onto the recording medium, a transmission clock CLK in synchronization with the image data, a latch signal, a parameter signal for generating a basic image waveform signal, and a jet timing signal JET output at a predetermined cycle according to a print timing signal to be transmitted from the CPU 80, and outputs these signals to the head driver 84. Further, the gate array 83 stores image data transmitted from an external device through an interface (I/F) 97 in the image memory 96.

According to the signals output from the gate array 83, the head driver 84 serving as a driving circuit applies driving pulses having waveforms corresponding to the signals to driving elements corresponding to the respective nozzles. The driving elements are driven by the driving pulses, and then ink is ejected from the respective nozzles.

Next, the operation of the recording head unit 5 at the time of purging or capping will be described with reference to FIGS. 13A to 13D. In FIGS. 13A to 13D, for the purpose of facilitating understanding, the cap unit 12 and the like are schematically shown.

Figure 13A:
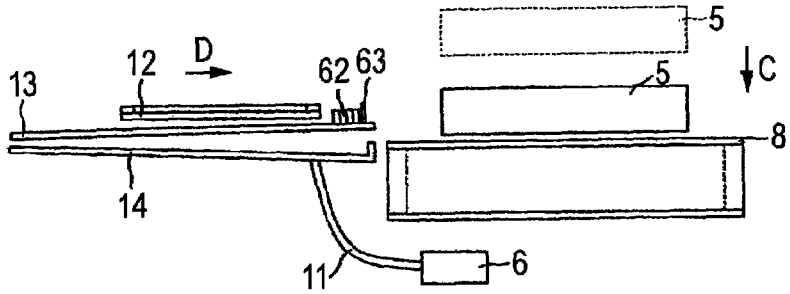
FIGS. 13A to 13D are diagrams illustrating the operations of the recording head unit and the like at the time of purging or capping.

FIG. 13A shows a state where ink is ejected from the recording head unit 5 to form an image on the recording medium on the conveyance belt 8. In this case, the recording head unit 5 is located at a position close to the conveyance belt 8, and the cap unit 12, the first ink receiving unit 13 and the second ink receiving unit 14 are located beside the recording head unit 5. Moreover, at this time, since the cap unit 12, the first ink receiving unit 13 and the second ink receiving unit 14 vertically overlap one another, the cap unit 12, the image forming apparatus can be downsized in the depth direction (the direction of the arrow D).

Figure 13B:
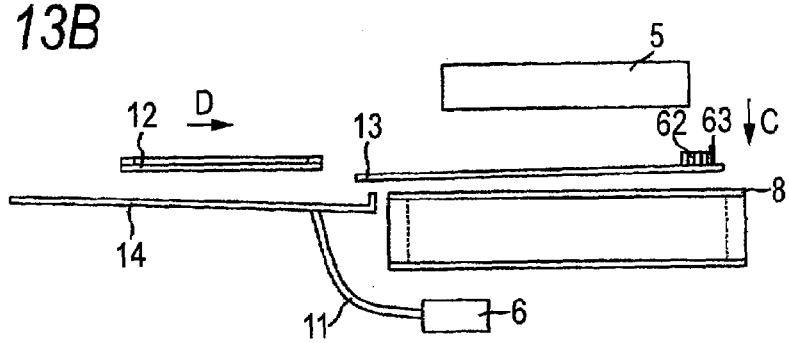
Figure 13C:
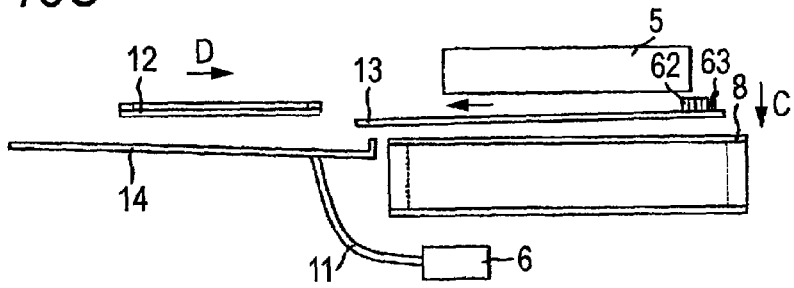

FIGS. 13B and 13C show the states of the recording head unit 5, the first ink receiving unit 13, and the like during the purge operation. When the purge operation starts, as shown in FIG. 13B, the recording head unit 5 is moved from the position shown in FIG. 13A in a direction opposite to a narrow C (a direction distant from the conveyance belt 8). Then, only the first ink receiving unit 13 is moved in the direction of the arrow D toward a space between the recording head unit 5 and the conveyance belt 8.

Next, as shown in FIG. 13C, the recording head unit 5 is moved again in the direction of the arrow C so that the respective nozzle formation surfaces of the recording head unit 5 abut against the end of the wiper 63 of the first ink receiving unit 13. Then, a higher pressure than that at the time of normal ink ejection is applied to the recording head unit 5 to eject ink from the nozzles toward the first ink receiving unit 13.

Subsequently, when the first ink receiving unit 13 is moved in the direction opposite to the arrow D, ink of a droplet shape adhering to the nozzle formation surfaces flows onto the first ink receiving unit 13 through the channels between the comb teeth formed in the ink introducing member 62. Then, ink adhering to the nozzle formation surfaces is wiped by the wiper 63, and flows onto the first ink receiving unit 13 along the wiper 13.

On the other hand, ink on the first ink receiving unit 13 flows toward the ink non-receiving position along the grooves 60 on the first ink receiving unit 13, and then flows onto the second ink receiving unit 14. Moreover, as shown in FIG. 4, in the state where the first ink receiving unit 13 is located at the ink receiving position, the end of the second ink receiving unit 14 on the ink receiving position side extends below the end of the first ink receiving unit 13 on the ink non-receiving position side. Accordingly, ink flowing from the ink non-receiving position side of the first ink receiving unit 13 can reliably fall onto the second ink receiving unit 14. Accordingly, ink falling onto the second ink receiving unit 14 is stored in the waste ink tank 6 through the tube 11.

Figure 13D:
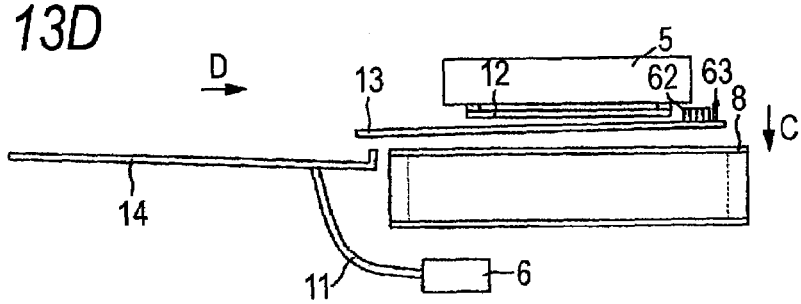

FIG. 13D is a diagram showing the states of the recording head unit 5, the cap unit 12, and the like at the time of capping. At the time of capping, first, as described with reference to FIG. 13B, the recording head unit 5 is moved from the position shown in FIG. 13A in the direction opposite to the arrow C (the direction distant from the conveyance belt 8).

Then, the cap unit 12 is moved in the direction of the arrow D together with the first ink receiving unit 13 toward a position between the recording head unit 5 and the conveyance belt 8. Subsequently, if the cap unit 12 reaches a predetermined capping position, the recording head unit 5 is moved in the direction of the arrow C so that the nozzle formation surfaces of the recording head unit 5 abut against the lip portions 41 of the cap unit 12. Thus, the closed space in which the nozzle formation surfaces is sealed off is formed.

Moreover, as for the operation from the capping state shown in FIG. 13D to the state shown in FIG. 13A, the recording head unit 5 is moved in the direction opposite to the arrow C, while the cap unit 12 is moved in the direction opposite to the arrow D together with the first ink receiving unit 13. Then, the recording head unit 5 is moved to the position shown in FIG. 13A again in the direction of the arrow C.

Figure 14A:
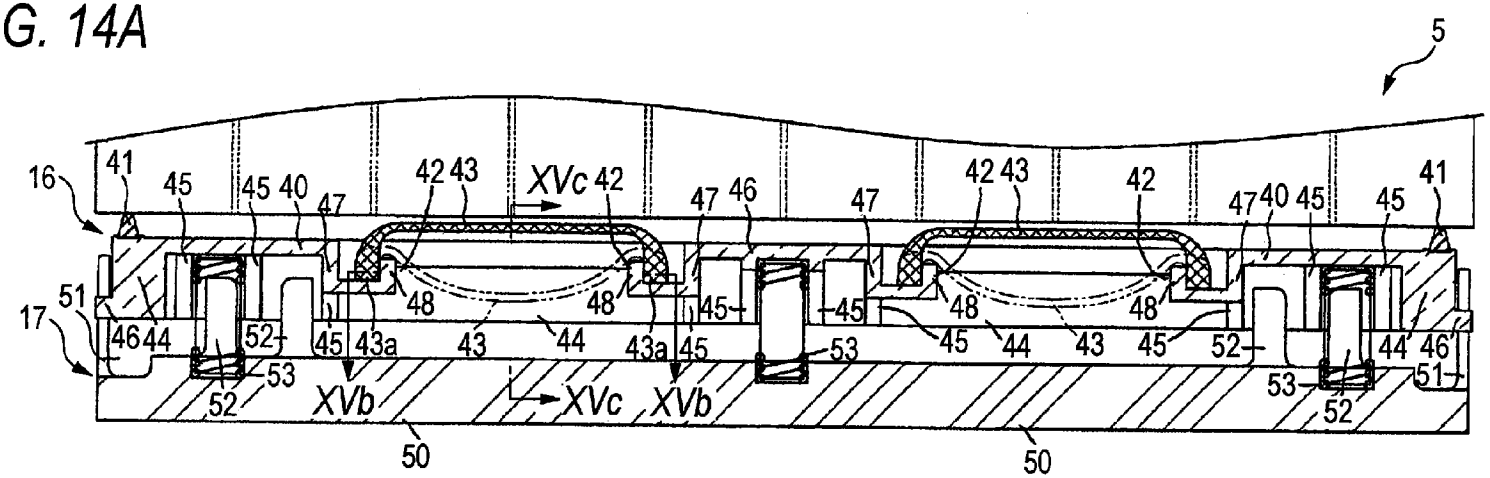
FIG. 14A corresponds to FIG. 9A and is an enlarged cross-sectional view showing a state where the lip portions of the cap main body abut against the nozzle formation surface.
Figure 14B:
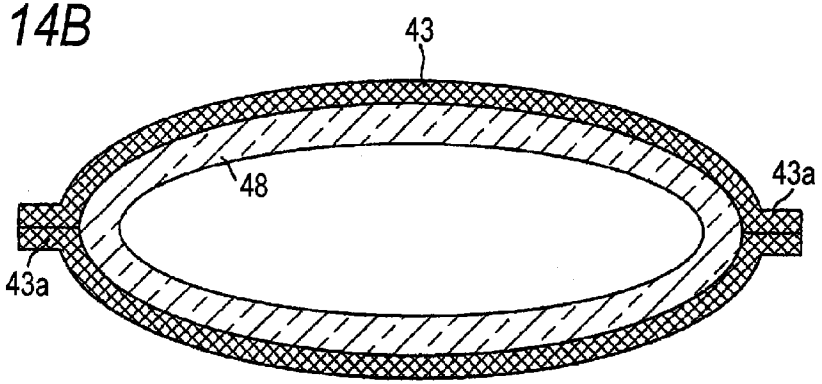
FIG. 14B is an enlarged cross-sectional view taken along a line XIVb-XIVb of FIG. 14A.
Figure 14C:
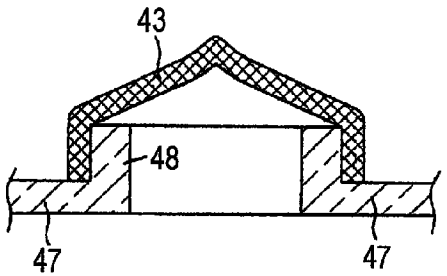
FIG. 14C is an enlarged cross-sectional view taken along a line XIVc-XIVc of FIG. 14A.

Next, a method of arranging a film 43 according to a second embodiment will be described with reference to FIGS. 14A to 14C. FIG. 14A corresponds to FIG. 9A and is an enlarged cross-sectional view showing a state where the lip portions 41 of the cap main body 16 abut against the nozzle formation surface. FIG. 14B is an enlarged cross-sectional view taken along a XIVb-XIVb of FIG. 14A. FIG. 14C is an enlarged cross-sectional view taken along a line XIVc-XIVc of FIG. 14A. Moreover, the same parts as those in the above-described embodiment are represented by the same reference numerals, and the descriptions thereof will be omitted.

In the above-described embodiment, the case where the flat plate-shaped films 43 cover the openings 42, which pass through and open the base portion 40 of the cap main body 16, has been described. In the arrangement method of the film 43 according to the second embodiment, a case where the film 43 is arranged in a dome shape (three-dimensional shape) will be described.

The film 43 is configured to be a bag shape by bending one plate-shaped film in double and sealing both edges except a portion opposite to the bent portion.

Further, concave portions 47 are formed in the base portion 40. The concave portions 47 are depressed so as to be more distant from the nozzle formation surface of the recording head unit 5 than the surface on which the lip portions 41. The openings 42 pass through the bottom surfaces of the concave portions 47 and are substantially formed in elliptic shapes in plan view as shown in FIG. 14B. In addition, protrusions 48 are formed on the bottom surface of each of the concave portions 47. The protrusions 48 surround the openings 42 and protrude toward the nozzle formation surface. The films 43 cover the protrusion 48 so that the bent portion faces the recording head unit 5, and thus the film 43 is formed in the dome shape, which is swelled toward the nozzle formation surface. The inner surfaces of the end portions of the films 43 are welded to the outer surfaces of the protrusions 48.

If the films 43 are arranged in such a method, when capping, the film 43 welded to be in the dome shape is swelled toward the opposite side to the nozzle formation surface as shown in a two-dot-chain line of FIG. 14A, due to the change in pressure at the time of capping, thereby absorbing the change in pressure. Accordingly, a movable range of the films 43 can be increased, as compared with the case where the films 43 are arranged in the flat plate shape as in the above-described embodiment. Thus, the films 43 can cope with a great change in pressure. Therefore, the meniscus can be reliably prevented from being destroyed. Further, even when an environmental temperature is changed during capping, the change in pressure in the closed space can be absorbed, like the above-described embodiment.

Figure 15:
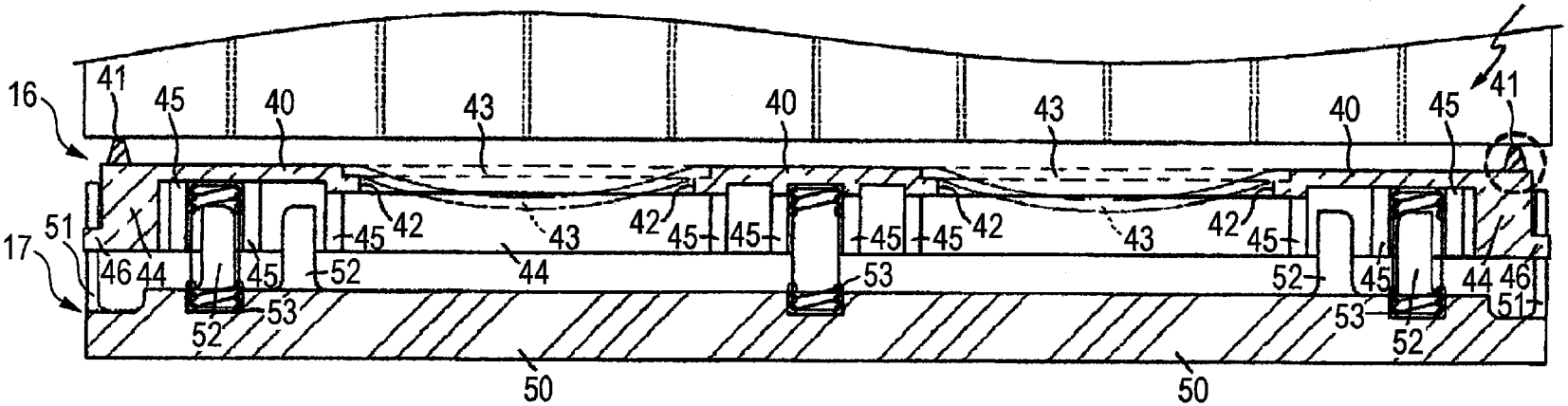
FIG. 15 corresponds to FIG. 9A and is an enlarged cross-sectional view showing a state where the lip portions of the cap main body abut against the nozzle formation surface.

Next, a method of arranging the film 43 according to a third embodiment will be described with reference to FIG. 15. FIG. 15 corresponds to FIG. 9A and is an enlarged cross-sectional view showing a state where the lip portions 41 of the cap main body 16 abut against the nozzle formation surface. The same parts as those in the above-described embodiments are represented by the same reference numerals, and the descriptions thereof will be omitted.

In the first embodiment, the film 43 is arranged to have a flat shape in section view initially as shown in FIG. 9A. In the third embodiment, the film 43 is arranged to have a convex shape protruding away from the nozzle formation surface in as section view taken along a direction in which the nozzles eject the ink toward the recording medium, as shown in FIG. 15.

End portions of the film 43 are welded to the base portion 40 and the film 43 has the convex shape protruding away from the nozzle formation surface as shown by a solid line in FIG. 15. In other words, the film 43 is convex to be distant from the nozzle formation surface, initially. When capping, the film 43 is swelled toward the opposite side to the nozzle formation surface due to the change in pressure at the time of capping, thereby absorbing the change in pressure. Assuming that negative pressure occurs in the closed space during capping. The negative pressure pulls the film 43 toward the nozzle formation surface side. In this case, since the film 43 is arranged to initially have the convex shape protruding away from the nozzle formation surface in the section view, the film 43 is deformed to be flat as shown by a dashed line of FIG. 15. Even if stronger negative pressure occurs, the film 43 is deformed to be convex upward to absorb the negative pressure without contacting with the nozzle formation surface and the nozzles. Accordingly, there is less chance that the meniscus in the nozzles are destroyed due to contact between the film 43 and the nozzle formation surface.

Figure 16:
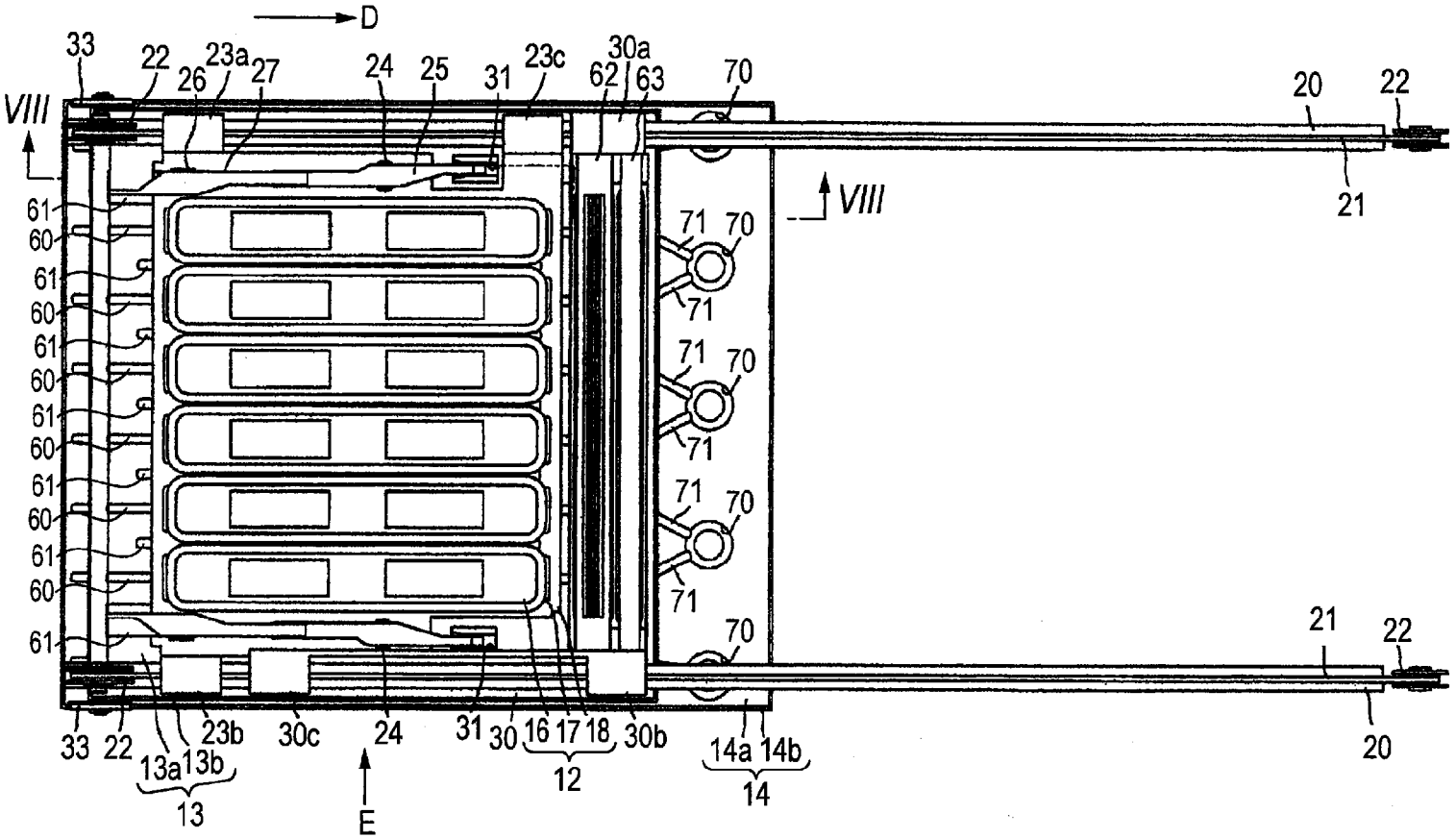
FIG. 16 corresponds to FIG. 3 and is a diagram illustrating a method of supporting a cap unit and a first ink receiving unit according to a second embodiment.

Next, a method of supporting the cap unit 12 and the first ink receiving unit 13 according to a second embodiment will be described with reference to FIG. 16. FIG. 16 corresponds to FIG. 3. The same parts as those in the above-described embodiment are represented by the same reference numerals, and the descriptions thereof will be omitted.

In the above-described embodiment, the case where the first support members 23 support the cap unit at the three points, and the second support members 30 support the first ink receiving unit 13 at the two points has been described. In contrast, as shown in FIG. 16, first support members 23*a*, 23*b*, and 23*c* may support the cap unit 12 at three points, and second support members 30*a*, 30*b*, and 30*c* may support the first ink receiving unit 13 by at three points.

Specifically, the first support members 23*a* and 23*b* support both ends of the cap tray 18 on the ink-non-receiving-position side, and the first support member 23*c* supports only one end of the cap tray 18 on the ink-receiving-position side.

According to this configuration, the cap unit 12 can be maintained to be parallel to the nozzle formation surface with high accuracy, as compared with the case where the both sides of the central portion of the cap tray 18 are supported as described above. Accordingly, when the cap unit 12 seals the nozzle formation surface, airtightness can be improved. Further, when the apparatus is not used, ink can be prevented from being dried.

Further, the second support members 30*a* and 30*b* support ends of the first ink receiving unit 13 on the ink-receiving-position side. The second support member 30*c* connected the second support member 30*b* is located on a guide rod 20 other than a guide rod 20 through which the first support member 23*c* passes and supports the first ink receiving unit 13.

According to this configuration, as compared with the above-described case, the ink introducing member 62 and the wiper 63 can be made parallel to the nozzle formation surface more accurately. Accordingly, ink adhering to the nozzle formation surface can be reliably removed.

In addition, even when the cap unit 12 and the first ink receiving unit 13 vertically overlap each other, since the first support members 23*a*, 23*b*, and 23*c* and the second support members 30*a*, 30*b*, and 30*c* are disposed in positions free from interference, the cap unit 12 and the first ink receiving unit 13 can be arranged compactly at the ink non-receiving position.

Further, among the first support members 23*a*, 23*b*, and 23*c*, the two first support members 23*a* and 23*c* for two-point support pass through the guide rod 20 with no clearance as shown in FIG. 17C. Further, the first support member 23*b* for one-point support is configured to have a clearance in the horizontal direction with respect to the guide rod 20 as shown in FIG. 17B.

Similarly, among the second support members 30*a*, 30*b*, and 30*c*, the two second support members 30*b* and 30*c* for two-point support pass through the guide rod 20 with no clearance as shown in FIG. 17C. Further, the second support member 30*b* for one-point support is configured to have a clearance in the horizontal direction with respect to the guide rod 20 as shown in FIG. 17B. According to this configuration, even when the guide rods 20 are not parallel in plan view, the distortion can be absorbed. Thus, the movement can be smoothly performed.

The invention has been described based on the exemplary embodiments, but is not limited to the exemplary embodiments. Various modifications can be made within a range not departing from the subject matter of the invention.

For example, the cap unit 12 and the first ink receiving unit 13 are integrally moved for the sake of capping, while only the first ink receiving unit 13 is moved in the purge operation. At this time, smaller torque is required when only the first ink receiving unit 13 is moved. Accordingly, the slide motor 92 serving as the driving source for driving the first ink receiving unit 13 may be a stepping motor. Then, when only the first ink receiving unit 13 is moved, the output interval of the driving pulse may be shortened. Thus, the moving time of the first ink receiving unit 13 at the time of the purge operation can be reduced. As a result, the purge operation can be executed at high speed.

Further, like the first ink receiving unit 13, ribs may be provided in the second ink receiving unit 14 so as to be disposed across the groove 71 from each other. In this case, ink can be prevented from leaking to adjacent grooves 71, and thus ink can smoothly flow.

Further, in the above-described embodiments, a case where the six connection holes 70 are provided in the second ink receiving unit 14, the tube 11 is connected to the respective connection holes 70, and ink is introduced into the waste ink tank 6 through the tube 11 has been described. However, instead of the six connection holes 70, one through hole may be provided. In this case, the tube 11 does not need to be connected to the respective connection holes 70, and thus the number of parts can be reduced.

In addition, a frame may be provided in the upper edge of the side wall 13*b* of the first ink receiving unit 13 so as to extend inward. In this case, ink can be prevented from flying into the image forming apparatus 1 from the first ink receiving unit 13.

Also, in the above embodiment, the film 43 is disposed so as to have the convex shape protruding away from the nozzle formation surface in the section view taken along a direction in which the nozzle eject the ink toward the recording medium. Alternatively, the film 43 may have a convex shape protruding toward the nozzle formation surface in the section view taken along a direction in which the nozzles eject the ink toward the recording medium.

What is claimed is:

1. An image forming apparatus comprising: a conveyance unit that conveys a recording medium in a first direction; a plurality of nozzles that eject ink toward the recording medium being conveyed by the conveyance unit; a recording unit that comprises a plurality of recording heads being arranged in parallel, each recording head comprising a nozzle formation surface formed with the nozzles; a cap unit that is able to abut against the nozzle formation surface of each recording head to form a closed space in which the nozzle formation surface is sealed up; a first moving mechanism that reciprocates the cap unit along a second direction crossing the first direction, between a capping position facing the nozzle formation surfaces and a non-capping position apart from the capping position; a first ink receiving unit that comprises an ink receiving region larger than a region that all the nozzles of the recording heads occupy; and a second moving mechanism that reciprocates the first ink receiving unit along the second direction, between an ink receiving position facing the nozzle formation surfaces and an ink non-receiving position apart from the ink receiving position, wherein: when the first ink receiving unit is located at the ink non-receiving position, at least a part of the first ink receiving unit overlaps the cap unit, which is located at the non-capping position, as viewed from a direction intersecting the nozzle formation surface, and when the cap unit is located at the capping position, the first ink receiving unit is located at the ink receiving position and overlaps the entire cap unit as viewed from the direction intersecting the nozzle formation surface.

2. The image forming apparatus according to claim 1, wherein: the cap unit is smaller than the ink receiving region of the first ink receiving unit as viewed from the direction intersecting the nozzle formation surface, and when the first ink receiving unit is located at the ink non-receiving position, the first ink receiving unit overlaps the entire cap unit located at the non-capping position as viewed from the direction intersecting the nozzle formation surface.

3. The image forming apparatus according to claim 1, wherein: the first moving mechanism and the second moving mechanism comprise common guide members on both sides thereof, the common guide members being disposed across the recording unit from each other, the common guide members extending across the recording unit in the second direction, the first moving mechanism reciprocates the cap unit in the second direction along the common guide members, and the second moving mechanism reciprocates the first ink receiving unit in the second direction along the common guide members.

4. The image forming apparatus according to claim 3, wherein the first moving mechanism comprises first support members through which the common guide members passes loosely, the first support members supporting the cap unit so that the cap unit is substantially parallel to the nozzle formation surface.

5. The image forming apparatus according to claim 4, further comprising: rails that extend along the second direction, the rails being disposed across the first ink receiving unit located at the ink non-receiving position from each other, wherein: the second moving mechanism comprises: second support members through which the common guide units pass loosely, the second support members located on an ink-receiving-position side with respect to the first support members, the second support members that support the first ink receiving unit; and rolling units that are connected to the first ink receiving unit, the rolling units located on an ink-non-receiving-position side with respect to the first support members, the rolling units that roll on the rails.

6. The image forming apparatus according to claim 5, wherein the second support members support the first ink receiving unit so that the first ink receiving unit is movable vertically toward a cap-unit side with respect to the second support members and away from the cap-unit side with respect to the second support members.

7. The image forming apparatus according to claim 5, wherein the second support members support the first ink receiving unit so that the first ink receiving unit pivots around a fulcrum, which is contact points between the rolling units and the rails, with respect to the second support members.

8. The image forming apparatus according to claim 7, wherein: each second support member comprises a shaft protruding toward the first ink receiving unit, and the first ink receiving unit is formed with holes elongating in a direction in which the first ink receiving unit and the cap unit overlap, each shaft being inserted into the corresponding hole of the first ink receiving unit.

9. The image forming apparatus according to claim 5, further comprising: a second ink receiving unit fixedly disposed at a lower position than the first ink receiving unit so as to receive ink flowing from the first ink receiving unit, wherein: the second ink receiving unit comprises: a bottom wall that receives the ink flowing from the first ink receiving unit; and side walls that are upright from edges of the bottom wall, which extends along the second direction, toward the first ink receiving unit, and upper edges of the side walls form the rails.

10. The image forming apparatus according to claim 3, wherein: the first moving mechanism supports the cap unit at two points in one of the common guide members and supports the cap unit at one point in the other of the common guide members, and the second moving mechanism supports the first ink receiving unit at one point in the one of the common guide members and supports the first ink receiving unit at two points in the other of the common guide members.

11. The image forming apparatus according to claim 1, further comprising: a connecting mechanism that connects the cap unit and the first ink receiving unit to each other; and a separating mechanism that separates the cap unit and the first ink receiving unit, which are connected to each other by the connecting mechanism, from each other, wherein: the first moving mechanism and the second moving mechanism comprises a common power supply unit that supplies power, the second moving mechanism reciprocates the first ink receiving unit independently of the cap unit along the second direction by power, which is supplied from the common power supply unit in a state where the cap unit and the first ink receiving unit are separated from each other by the separating mechanism, and the first moving mechanism reciprocates the cap unit and the first ink receiving unit along the second direction by power, which is supplied from the common power supply unit in the state where the cap unit and the first ink receiving unit are connected to each other by the connecting mechanism.

12. The image forming apparatus according to claim 1, further comprising: a second ink receiving unit fixedly disposed at a lower position than the first ink receiving unit so as to receive ink flowing from the first ink receiving unit.

13. The image forming apparatus according to claim 12, wherein when the first ink receiving unit is located at the ink non-receiving position, the second ink receiving unit is located just below the first ink receiving unit.

14. The image forming apparatus according to claim 12, wherein when the first ink receiving unit is located at the ink non-receiving position, at least a part of an ink receiving surface of the second ink receiving unit overlaps the ink receiving surface of the first ink receiving unit as viewed from the direction intersecting the nozzle formation surface.

15. The image forming apparatus according to claim 14, wherein when the first ink receiving unit is located at the ink non-receiving position, the ink receiving surface of the second ink receiving unit overlaps the entire ink receiving surface of the first ink receiving unit as viewed from the direction intersecting the nozzle formation surface.

16. The image forming apparatus according to claim 12, wherein the ink receiving surface of the first ink receiving unit inclines downward from an ink-receiving-position side toward an ink-non-receiving-position side.

17. The image forming apparatus according to claim 12, further comprising: a storing unit that stores the ink ejected from the nozzles, wherein: the ink receiving surface of the second ink receiving unit is formed with a connection hole communicating with the storing unit.

18. The image forming apparatus according to claim 17, wherein the ink receiving surface of the second ink receiving unit inclines downward toward the connection hole.

19. The image forming apparatus according to claim 17, wherein the connection hole is formed on a front-end side of the second ink receiving unit in a direction from the ink non-receiving position toward the ink receiving position.

20. The image forming apparatus according to claim 17, wherein when the first ink receiving unit is located at the ink receiving position, an end of the first ink receiving unit on the ink-non-receiving-position side is located above the connection hole.

21. The image forming apparatus according to claim 17, wherein the ink receiving surface of the second ink receiving unit is formed with a second groove extending toward the connection hole.

22. The image forming apparatus according to claim 21, wherein: the ink receiving surface of the second ink receiving unit comprises a region where the second groove is not formed, and the region has better water-repellent property than a region where the second groove is formed.

23. The image forming apparatus according to claim 21, wherein the second groove has a substantial V shape in a sectional view.

24. The image forming apparatus according to claim 12, wherein the ink receiving surface of the first ink receiving unit is formed with a first groove extending along the second direction.

25. The image forming apparatus according to claim 24, wherein: the ink receiving surface of the first ink receiving unit comprises a region where the first groove is not formed, and the region has better water-repellent property than a region where the first groove is formed.

26. The image forming apparatus according to claim 24, wherein when the first ink receiving unit is located at the ink receiving position, the first groove is located substantially just below the nozzles.

27. The image forming apparatus according to claim 24, wherein: the first ink receiving unit further comprises ribs on both sides of the first groove, and the ribs are upright from the ink receiving surface of the first ink receiving unit, the ribs being disposed across the first groove from each other.

28. The image forming apparatus according to claim 24, wherein when the first ink receiving unit has moved to the ink receiving position, the connection hole is located on an extension line of the first groove.

29. The image forming apparatus according to claim 24, wherein the first groove has a substantial V shape in a sectional view.

30. The image forming apparatus according to claim 1, further comprising: an ink introducing member that introduces ink adhering to the recording heads into the first ink receiving unit, has a comb shape, is separate from the nozzle formation surface and is disposed on a front-end side of the first ink receiving unit in a direction from the ink non-receiving position toward the ink receiving position.

31. The image forming apparatus according to claim 30, further comprising: a wiping unit that is located on a further front end of the first ink receiving unit than the ink introducing member and is upright toward the nozzle formation surface to be able to abut against the nozzle formation surface and wipe the ink adhering to the nozzle formation surface.

* * * * *